US008769758B2

(12) United States Patent
Jungnickel et al.

(10) Patent No.: US 8,769,758 B2
(45) Date of Patent: Jul. 8, 2014

(54) FORCE SENSING ORAL CARE INSTRUMENT

(75) Inventors: Uwe Jungnickel, Koenigstein/Taunus (DE); Soeren Jan Wasow, Freigericht (DE); Bert Schrempel, Hanau (DE); Niclas Altmann, Schoeneck (DE); René Guebler, Friedberg (DE)

(73) Assignee: The Gillette Company, Boston, MA (US)

( * ) Notice: Subject to any disclaimer, the term of this patent is extended or adjusted under 35 U.S.C. 154(b) by 203 days.

(21) Appl. No.: 13/237,443

(22) Filed: Sep. 20, 2011

(65) Prior Publication Data

US 2012/0198640 A1 Aug. 9, 2012

Related U.S. Application Data

(60) Provisional application No. 61/384,485, filed on Sep. 20, 2010, provisional application No. 61/440,929, filed on Feb. 9, 2011, provisional application No. 61/482,888, filed on May 5, 2011.

(51) Int. Cl.
*A46B 15/00* (2006.01)

(52) U.S. Cl.
USPC ..... 15/105; 15/167.1; 433/141; 600/589; 600/590

(58) Field of Classification Search
CPC ..... A46B 15/0012; A46B 15/0038–15/0046
USPC ..... 15/105, 167.1; 433/141; 600/589, 590; 601/141; 606/161; 116/202, 212
See application file for complete search history.

(56) References Cited

U.S. PATENT DOCUMENTS

| | | | | | |
|---|---|---|---|---|---|
| 4,341,230 | A | * | 7/1982 | Siahou | 434/263 |
| 4,476,604 | A | * | 10/1984 | White et al. | 15/105 |
| 4,802,255 | A | | 2/1989 | Breuer et al. | |
| 5,268,005 | A | | 12/1993 | Suhonen | |
| 5,282,291 | A | * | 2/1994 | Spieler et al. | 15/167.1 |
| 5,313,909 | A | | 5/1994 | Tseng et al. | |
| 5,331,707 | A | * | 7/1994 | Irizarry | 15/167.1 |
| 5,722,106 | A | | 3/1998 | Masterman et al. | |
| 5,836,769 | A | | 11/1998 | Spencer | |

(Continued)

FOREIGN PATENT DOCUMENTS

| | | | |
|---|---|---|---|
| JP | 2-101490 | * | 4/1990 |
| JP | 5-111409 | * | 5/1993 |

(Continued)

*Primary Examiner* — Mark Spisich
(74) *Attorney, Agent, or Firm* — George Henry Leal; Vladimir Vitenberg

(57) ABSTRACT

An insert for an oral hygiene handle having a cavity is described. The insert has a load member capable of pivoting with respect to the housing and an output source disposed in electromagnetic communication with the load member, a power source in electrical communication with the output source having first and second contact areas, and an indication element forming an outer facing surface. When the load member pivots a predetermined amount, a first contact arm makes contact with a first contact area and/or a second contact arm makes contact with the second contact area thereby causing the power source to deliver power to the output source, wherein the output source provides electromagnetic energy to the load member, wherein the load member transmits the electromagnetic energy from the output source to the indication element, and wherein load member, the indication element, and the engagement section are integral with one another.

12 Claims, 29 Drawing Sheets

(56) References Cited

U.S. PATENT DOCUMENTS

| | | | | |
|---|---|---|---|---|
| 6,018,840 | A | 2/2000 | Guay et al. | |
| 6,058,541 | A | 5/2000 | Masterman et al. | |
| 6,151,745 | A | 11/2000 | Roberts et al. | |
| 6,475,553 | B2 | 11/2002 | Guay et al. | |
| 6,553,604 | B1 | 4/2003 | Braun et al. | |
| 7,120,960 | B2 | 10/2006 | Hilscher et al. | |
| 7,383,603 | B2 * | 6/2008 | Edwards | 15/185 |
| 8,544,131 | B2 * | 10/2013 | Braun et al. | 15/22.1 |
| 2004/0154112 | A1 | 8/2004 | Braun et al. | |
| 2005/0053896 | A1 | 3/2005 | Pinyayev et al. | |
| 2006/0080794 | A1 | 4/2006 | Punshon | |
| 2006/0272112 | A9 | 12/2006 | Braun et al. | |
| 2007/0251040 | A1 | 11/2007 | Braun et al. | |
| 2008/0109973 | A1 | 5/2008 | Farrell et al. | |
| 2009/0246430 | A1 | 10/2009 | Kriegel et al. | |
| 2010/0028512 | A1 | 2/2010 | Kriegel et al. | |
| 2011/0289708 | A1 | 12/2011 | Jimenez et al. | |

FOREIGN PATENT DOCUMENTS

| | | | |
|---|---|---|---|
| JP | 7-236519 | * | 9/1995 |
| JP | 9-322824 | * | 12/1997 |
| JP | 10-108734 | * | 4/1998 |
| JP | 2001-299451 | * | 10/2001 |

* cited by examiner

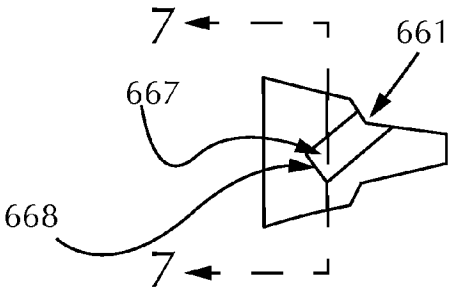
Fig. 6C
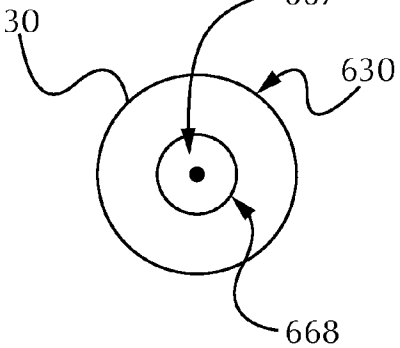
Fig. 7A
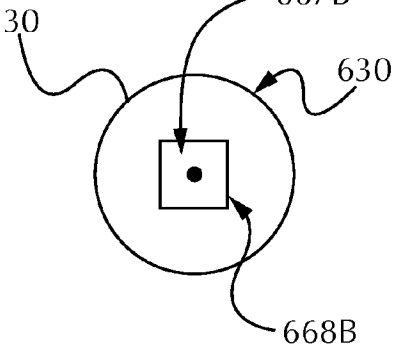
Fig. 7B
Fig. 7C
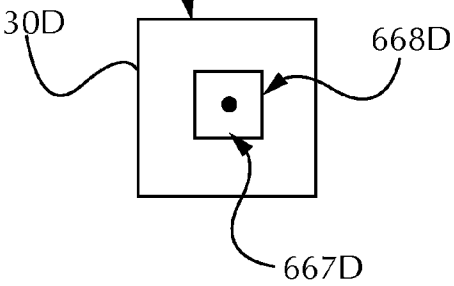
Fig. 7D
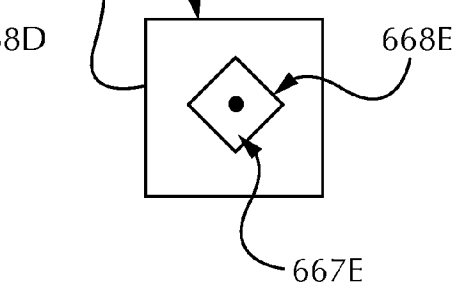
Fig. 7E

FORCE SENSING ORAL CARE INSTRUMENT

CROSS REFERENCE OF RELATED APPLICATION

This application claims the benefit of provisional application Ser. No. 61/384,485, filed on Sep. 20, 2010, provisional application Ser. No. 61/440,929, filed Feb. 9, 2011, and provisional application Ser. No. 61/482,888, filed on May 5, 2011, each of which are incorporated by reference in their entirety herein.

FIELD OF THE INVENTION

The present invention pertains to a personal hygiene device, more particularly to a personal hygiene device including a force indication system.

BACKGROUND OF THE INVENTION

The utilization of toothbrushes to clean one's teeth has long been known. During the brushing process, a user generally applies a force to the brush which is applied against the teeth and gums by the cleaning elements of the toothbrush. A minimum level of force must be applied to remove plaque and debris; however, high levels of force may have negative health consequences for an individual. For example, issues such as gum irritation, or over periods of time, gum recession or tooth enamel abrasion may occur. Unfortunately, the presence of these issues may exacerbate a contributing factor to the issues, i.e. high brushing force. Because some users may feel that these issues stem from poor cleaning, in an effort to correct the issues the users may apply even more force during brushing which in turn may cause more gum irritation and/or gum recession or tooth enamel abrasion.

In order to avoid or mitigate these issues, dental professionals may recommend the use of a soft bristled toothbrush. However, the use of a soft bristled toothbrush does not preclude the application of high brushing forces to the oral cavity. Furthermore, it is extremely difficult for an individual, when brushing, to determine the optimal force required for cleaning. While a user may apply a minimum level of force to enable cleaning, feeling the level at which the force is too high is difficult. In addition, studies have shown that the cleaning ability of a toothbrush may in fact be reduced if brushing force is increased to too high a level.

Other recommended solutions may be to apply less force while brushing. However, if too little force is applied during brushing, the cleaning efficacy of the toothbrush often can be reduced. Furthermore, similar to high brushing forces, the individual may find it difficult to determine when brushing forces are too low.

Accordingly, a need exists for a personal hygiene implement which signals to the user when too high a brushing force is being applied.

SUMMARY OF THE INVENTION

An oral hygiene handle having a cavity therein and an insert disposed within the cavity is described herein. The insert comprises a load member capable of pivoting with respect to the housing; an output source disposed in electromagnetic communication with the load member, the output source having a first contact arm and a second contact arm; a power source in electrical communication with the output source, the power source having a first contact area and a second contact area; an engagement section capable of receiving an oral care attachment; and an indication element forming an outer facing surface of the oral hygiene implement. Wherein when the load member pivots a predetermined amount, the first contact arm makes contact with a first contact area and/or the second contact arm makes contact with the second contact area thereby causing the power source to deliver power to the output source, wherein the output source provides electromagnetic energy to the load member, wherein the load member transmits the electromagnetic energy from the output source to the indication element, and wherein load member, the indication element, and the engagement section are integral with one another.

BRIEF DESCRIPTION OF THE DRAWINGS

FIG. 6C is a close up view showing the proximal end of the insert of FIG. 6A with some features removed for ease of explanation.

FIGS. 7A-7E are cross sectional views showing various embodiments of an indication element and reflective core shown in FIG. 6C, each being taken along line 7-7.

DETAILED DESCRIPTION OF THE INVENTION

Definitions

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

As used herein "personal hygiene implement" refers to any implement which can be utilized for the purposes of personal hygiene. Some suitable examples include toothbrushes, either manual or powered; razors, either manual or powered; shavers, either manual or powered; trimmers, etc.

As used herein, "oral hygiene implement" refers to any device which can be utilized for the purposes of oral hygiene. Some suitable examples of such devices include toothbrushes (both manual and power), flossers (both manual and power), water picks, and the like.

DESCRIPTION

For ease of explanation, the oral hygiene implement described hereafter shall be a manual toothbrush; however, as stated above, an oral hygiene implement constructed in accordance with the present invention is not limited to a manual toothbrush construction. Additionally, the embodiments described hereafter are equally applicable to blades, razors, other personal hygiene implements, or the like.

Figure 1:
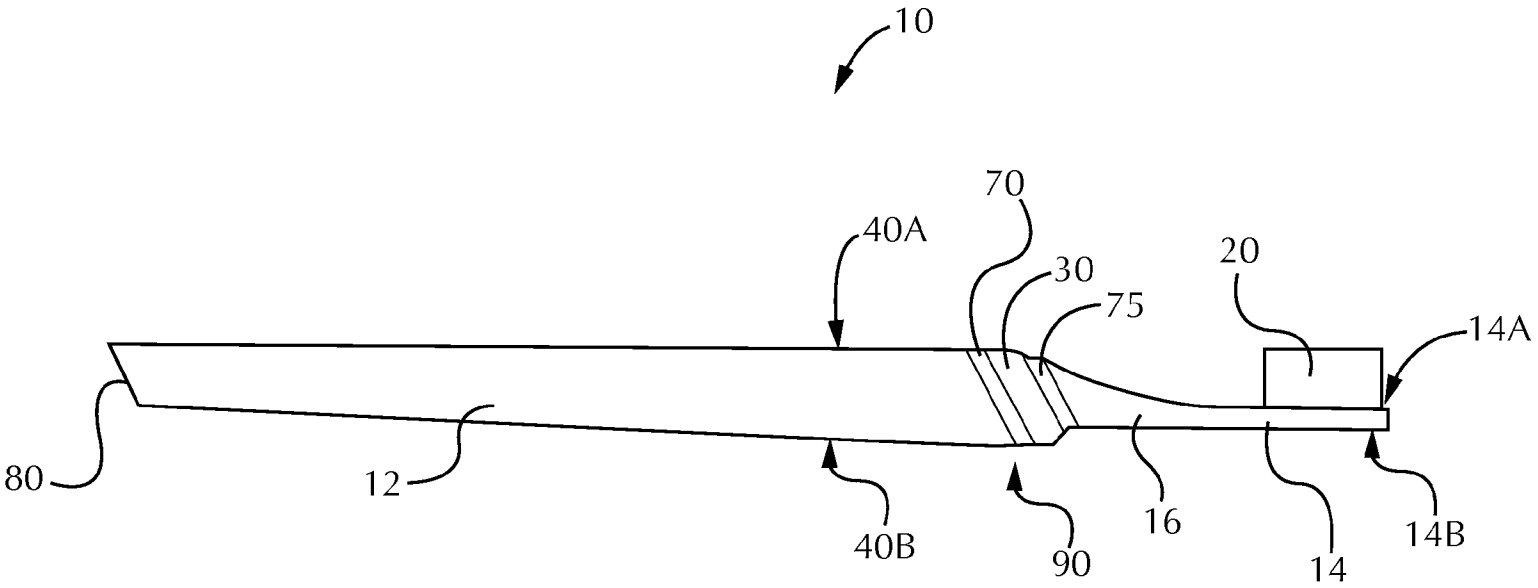
FIG. 1 is an elevational view showing a left side of an oral hygiene implement, e.g. a toothbrush, constructed in accordance with the present invention.

As shown in FIG. 1, a toothbrush 10 comprises a handle 12, a head 14, and a neck 16 extending between the handle 12 and the head 14. A contact element field 20 extends from a first surface 14A of the head 14. The handle 12 may comprise a distal end 80 and a proximal end 90. A tongue cleaner, soft tissue cleanser, massaging element, or the like, may be disposed on a second surface 14B of the head 14. The contact element field 20, the tongue cleaners, soft tissue cleansers, massaging elements, or the like, are discussed hereafter.

An indication element 30 may be disposed between the handle 12 and the neck 16 adjacent the proximal end 90. The indication element 30 may provide a visible signal to a user for at least one of a plurality of conditions. For example, the visible signal may be provided when a user has brushed for an adequate amount of time, e.g. two minutes, when the toothbrush needs to be replaced, and/or when the user is applying too much force when brushing. Additional conditions for which a signal may be provided are discussed hereafter.

The indication element 30 may be placed in any suitable location on the toothbrush 10. For example, in some embodiments, the indication element 30 may surround the neck 16 or may surround the handle 12. As another example, the indication element 30 may surround a portion of the handle 12 and/or a portion of the neck 16. As yet another example, the indication element 30 may be disposed on a back-facing surface 40B of the handle 12 and/or the neck 16. As yet another example, the indication element 30 may be disposed on a front-facing surface 40A of the handle 12 and/or the neck 16.

Figure 2A:
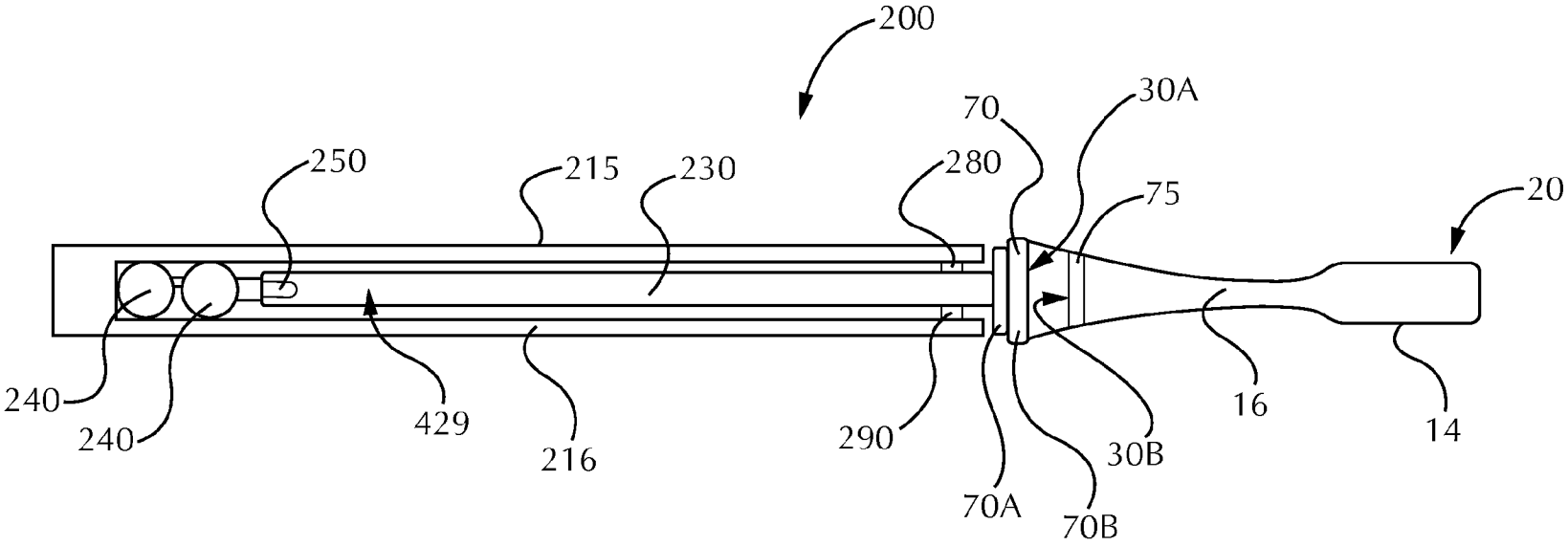
FIG. 2A is a plan view showing an insert of the toothbrush for FIG. 1.
Figure 2B:
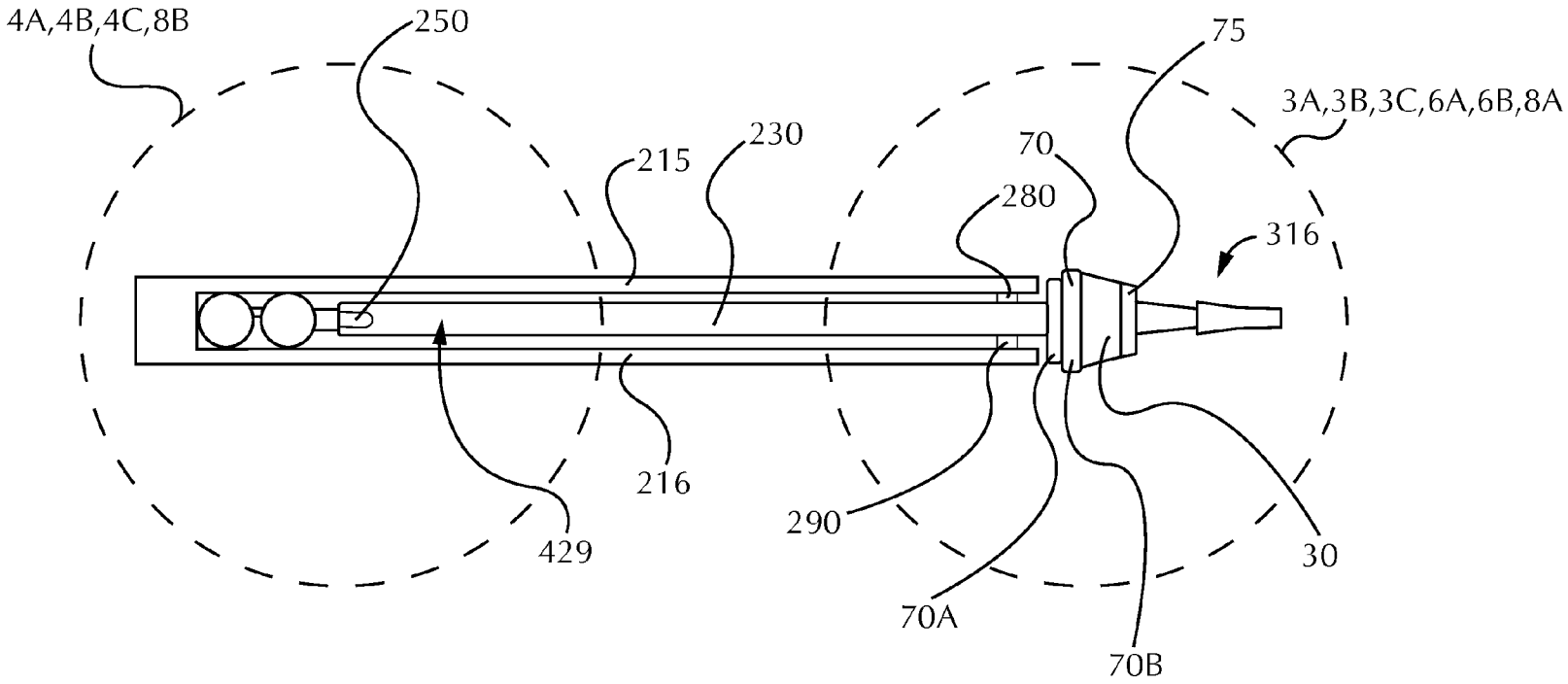
FIG. 2B is a plan view of the insert of FIG. 1 with an optional removable head/neck.

Referring to FIGS. 1-2B, as shown, the indication element 30 may be positioned between a first sealing element 70 and a second sealing element 75. The first sealing element 70 may be configured to preclude or reduce the likelihood of moisture entering into the handle 12. For example, the first sealing element 70 may have a first portion 70A which sealingly engages an interior surface of the handle 12. Additionally, the first sealing element 70 may have a second portion 70B which sealingly engages a proximal surface 30A of the indication element 30 and sealingly engages an interface between the handle 12 and the first sealing element 70. As an additional example, the second sealing element 75 may sealingly engages a distal surface 30B of the indication element 30 and sealingly engage the neck 16.

Embodiments are contemplated where the head 14 is replaceable, e.g. removably attached to the neck 16. In such embodiments, after the head 14 has been used for a particular period of time, e.g. three months, the head 14 may be replaced by a another new head. Similarly, embodiments are contemplated where the head 14 and neck 16 are integrally formed, e.g. unitary. In such embodiments, the neck 16 may be removably attached to the handle 12 and can be replaced after a period of time, e.g. three months. Additionally, in such embodiments, the neck 16 may have receiving section which is configured to receive an engagement section 316. As is shown in FIG. 3, the engagement section 316 may comprise detents which act as snap features which preclude or reduce the likelihood that the neck 16 can be removed during normal brushing by a user.

Regarding FIGS. 2A and 2B, an insert 200 may be disposed within the handle 12 (shown in FIG. 1). The insert 200 may comprise a first support 215 and a second support 216. The insert 200 may further comprise a load member 230, a power source 240, and an electromagnetic source 250, e.g. LED. The first support 215 and the second support 216 may provide support for the load member 230, power source 240, and electromagnetic source 250 within the handle 12 (shown in FIG. 1). For example, the first support 215 and the second support 216 may be configured to engage structures within the handle 12 (shown in FIG. 1) in order to lock the insert 200 in place during use. Additionally, the first support 215, the second support 216, and the structure within the handle 12 (shown in FIG. 1) may comprise detents to lock the insert 200 within the handle 12 (shown in FIG. 1). In some embodiments, in addition to the supports and/or detents, or independently thereof, a fastening element, e.g. screw may be utilized in the distal end 80 (shown in FIG. 1) to attach the insert 200 to the handle 12 (shown in FIG. 1). Other suitable fastening elements are contemplated, for example, adhesive, Velcro™, the like, or combinations thereof.

Figure 3A:
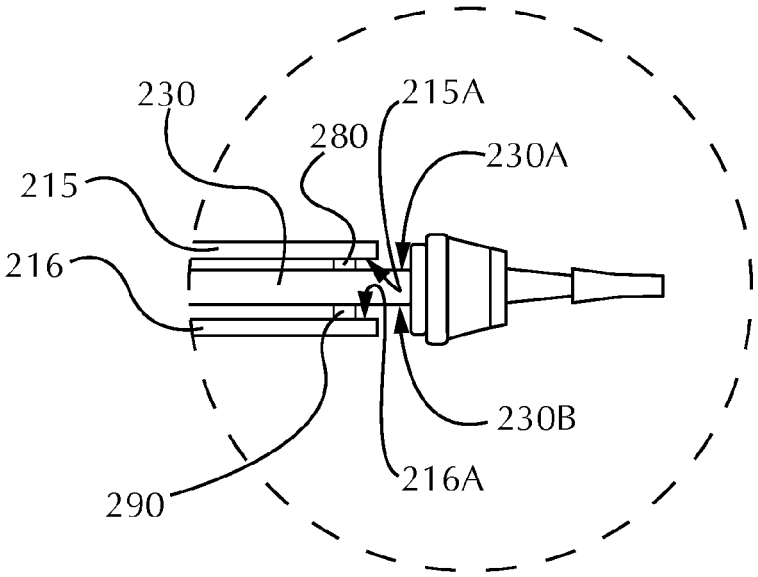
FIG. 3A is a close up view showing a proximal portion of the insert of FIG. 2B.
Figure 3B:
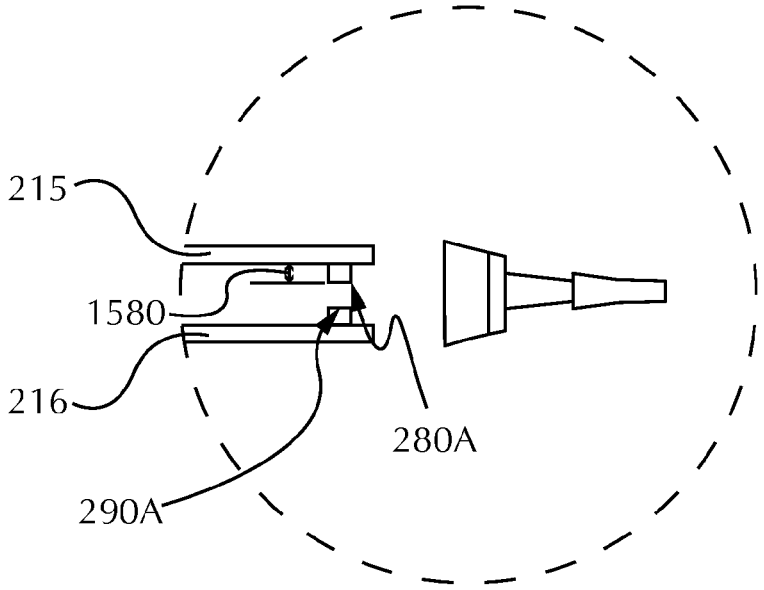
FIG. 3B, is a close up view showing the proximal portion of the insert of FIG. 2B with a load member removed for ease of explanation.
Figure 3C:
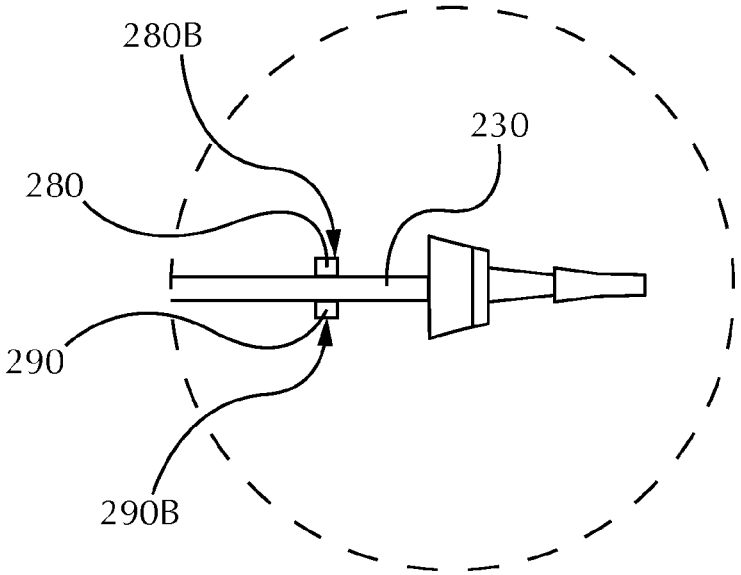
FIG. 3C is a close up view showing the proximal portion of the insert of FIG. 2B with support removed for ease of explanation.

As shown, in some embodiments, the load member 230 may be pivotally attached to the first support 216 and/or the second support 215 via springs 280 and/or 290. Referring to FIGS. 3A-3C, the springs 280 and 290 may comprise torsion bars. The springs 280 and 290 should be constructed such that pivoting of the load member 230 does not cause plastic deformation in the springs 280 and 290. Instead, the pivoting motion of the load member 230 should only cause elastic deformation of the springs 280 and 290.

The springs 280 and 290 should be designed to avoid fatigue failure. Variables which can impact fatigue failure and elastic deformation are material selection, sizing of the springs, and angular displacement of the springs 280 and 290.

The springs 280 and 290 may comprise any suitable size. For example, in some embodiments, the springs 280 and 290 may comprise a cross section area which is greater than about 3 $mm^2$ to about 50 $mm^2$, or any individual number within the range. In some embodiments, the springs may comprise a cross sectional area of between about 10 $mm^2$ to about 20 $mm^2$. Still in other embodiments, the springs may comprise a cross sectional area which is greater than about 3 $mm^2$, greater than about 5 $mm^2$, greater than about 7 $mm^2$, greater than about 10 $mm^2$, greater than about 15 $mm^2$, greater than about 17 $mm^2$, greater than about 20 $mm^2$, greater than about 25 $mm^2$, greater than about 30 $mm^2$, greater than about 35 $mm^2$, greater than about 40 $mm^2$, greater than about 45 $mm^2$, and/or less than about 50 $mm^2$, less than about 45 $mm^2$, less than about 40 $mm^2$, less than about 35 $mm^2$, less than about 30 $mm^2$, less than about 25 $mm^2$, less than about 20 $mm^2$, less than about 15 $mm^2$, less than about 12 $mm^2$, less than about 10 $mm^2$, less than about 7 $mm^2$, less than about 5 $mm^2$, or any ranges within the disclosed numbers. However, it is worth noting that if the cross sectional area of the springs 280 and 290 is too great, then the load member 230 will tend to bend as opposed to pivoting.

The springs 280 and 290 can be configured to influence the response force. One example of influencing the response force, is to change the cross sectional area of the springs 280 and/or 290. Other examples of influencing the response force include material selection, length of the spring.

In some embodiments, the load member 230 may be created separately from the springs 280 and/or 290 and later attached thereto. In such embodiments, the spring 280 may be configured such that a first surface 230A of the load member 230 engages a first engaging surface 280A of the spring 280 such that the first surface 230A does not rotate with respect to the first engaging surface 280A. Similarly, the spring 290 may be configured such that a second surface 230B does not rotate with respect to a first engaging surface 290A of the spring 290.

As an example, the first engaging surface 280A may comprise a detent which engages with a complimentary depression in the first surface 230A. As another example, the first engaging surface 280A may comprise a complimentary depression which engages a detent which is comprised by the first surface 230A. As yet another example, both the first engaging surface 280A and the first surface 230A may comprise a detent and a depression and be configured such that the detent of the first surface 230A engages the depression of the first engaging surface 280A and such that the detent of the first engaging surface 280A engages the depression of the first surface 230A. The second surface 230B and the first engagement surface 290A may be configured similarly. Embodiments are contemplated where a plurality of detents and complimentary depressions may be utilized on the first surface 230A, the second surface 230B, and/or the first engaging surfaces 280A and 290A.

In some embodiments, the load member 230 may be integrally formed with the springs 280 and/or 290. In such embodiments, the springs 280 and/or 290, may be configured such that a first inner-facing surface 215A of the first support 215 engages a second engaging surface 280B of the spring 280 such that the first inner-facing surface 215A does not rotate with respect to the second engaging surface 280B. Similarly, the spring 290 may be configured such that a second inner-facing surface 216A does not rotate with respect to a second engaging surface 290B of the spring 290. The detents and depressions described heretofore may be utilized in order to preclude or at least reduce the likelihood of rotation.

As mentioned heretofore, the length of the springs 280 and/or 290 can impact the response force provided by the springs 280 and/or 290. A length 1580 of spring 280 is defined by the distance between the first engaging surface 280A and the second engaging surface 280B. The length 1580 of the spring 280 may be impacted by the material selected for the spring. Additional factors include aesthetics as well as gripability by a user. The length 1580 may be any suitable length. In some embodiments, the length 1580 may be greater than about 1 mm, greater than about 1.5 mm, greater than about 2.0 mm, greater than about 2.5 mm, greater than about 3.0 mm, greater than about 3.5 mm, greater than about 4.0 mm, greater than about 4.5 mm, greater than about 5.0 mm, greater than about 5.5 mm, greater than about 6 mm, greater than about 6.5 mm, greater than about 7 mm, greater than about 7.5 mm, and/or equal to about 8.0 mm, less than about 7.5 mm, less than about 7.0 mm, less than about 6.5 mm, less than about 6.0 mm, less than about 5.5 mm, less than about 5.0 mm, less than about 4.5 mm, less than about 4.0 mm, less than about 3.5 mm, less than about 3.0 mm, less than about 2.5 mm, less than about 2.0 mm, less than about 1.5 mm, or any numbers or ranges within or including the values above. Spring 290 may be constructed similarly.

For ease of assembly embodiments are contemplated where the load member 230 is integrally formed with the first support 215, the second support 216, and/or springs 280 and 290. In some embodiments, the load member 230 may be integrally formed with the first support 215, the second support 216, springs 280 and 290, and/or engagement portion 316.

Figure 4A:
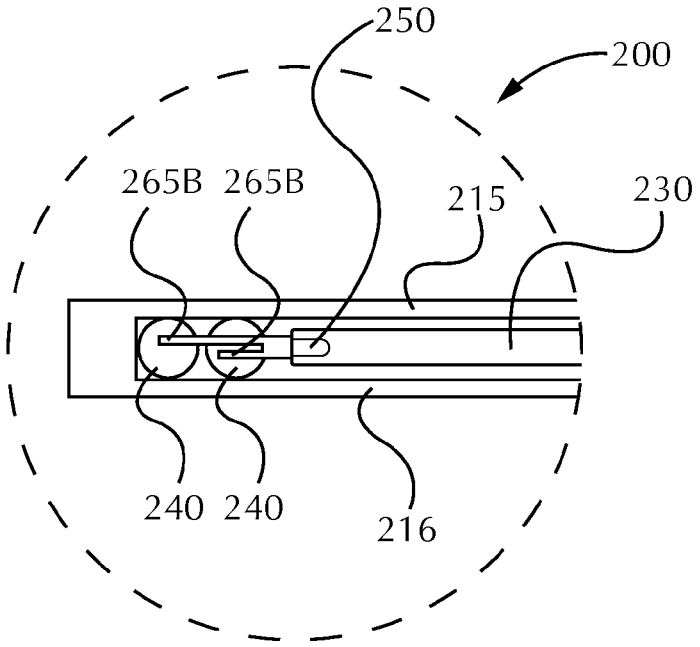
FIG. 4A is a close up view showing a first face of a distal portion of the insert of FIG. 2B.

Referring to FIG. 4A, a second portion of the insert 200 is shown. The load member 230 may comprise a first contact arm 265A and a second contact arm 265 B which can provide electrical communication between the electromagnetic source 250 and the power source(s) 240. Embodiments are contemplated where only a single power source is utilized. In such embodiments, only one contact arm may be required.

Figure 4B:
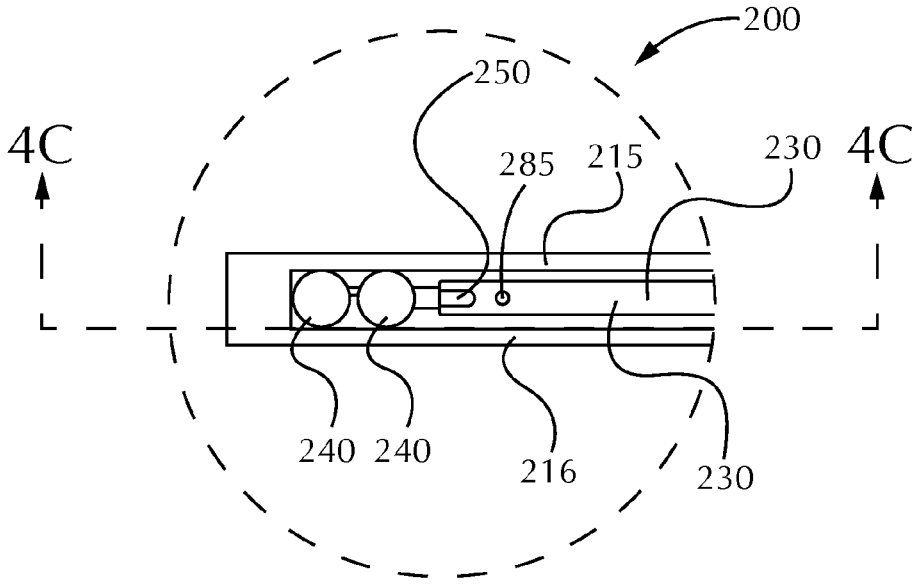
FIG. 4B is a close up view showing a second face of the distal portion of the insert of FIG. 2B.
Figure 4C:
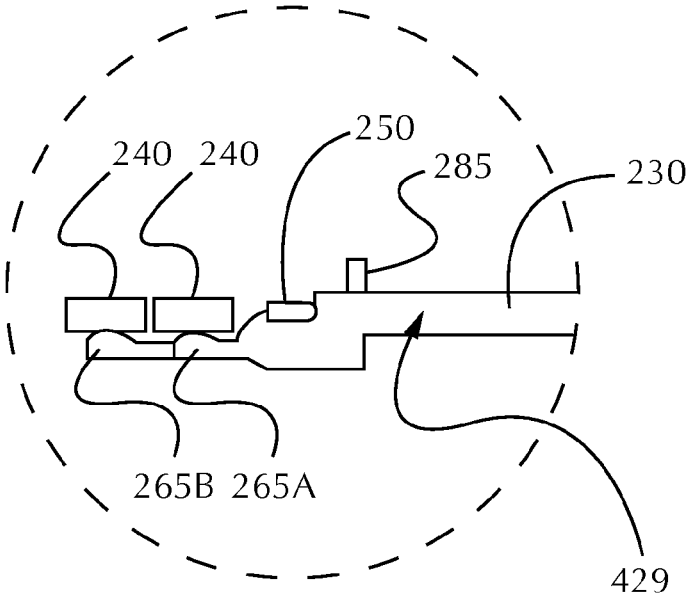
FIG. 4C is a close up view showing a cross section of the distal portion of the insert of FIG. 2B taken along line 4C-4C.

Referring to FIGS. 4A through 4C, the load member 230 may comprise a stop 285 which is configured to engage an inner surface of the handle 12 (shown in FIG. 1). In operation, when a sufficient force is applied to the cleaning element field 20 (shown in FIG. 1) the load member 230 pivots with respect to the first support 215 and/or second support 216. If the applied force is too high, then the load member 230 pivots such that the first contact arm 265A and the second contact arm 265B establish electrical communication between the power source(s) 240 and the electromagnetic source 250. Because the contact arms 265A and 265B are in contact with their respective power source(s) 240, additional applied force tends to cause deflection in the load member 230. This deflection in the load member 230 may lead to plastic deformation in the load member 230 and/or the contact arms 265A and/or 265B. In an effort to reduce the likelihood of plastic deformation, the stop 285 may be disposed on the load member 230. The stop 285 may be integrally formed with the load member 230, or the stop 280 may be a discrete element which is attached to the load member 230.

The stop 285 may be positioned in any suitable location along the load member 230. Additional embodiments are contemplated where the load member 230 comprises a plurality of stops. Furthermore, embodiments are contemplated where the handle comprises a stop protruding toward the load member 230 from an inner surface of the handle. Embodiments are contemplated where a plurality of stops protrude from an inner surface of the handle. Also, embodiments are contemplated where a plurality of stops are utilized and at least one protrudes from the load member 230 and at least one protrudes from the inner surface of the handle.

Referring to FIG. 4C, the stop 285 may be any suitable size. For example, the stop 285 may have a height 281 which is greater than about 1 mm, greater than about 2 mm, greater than about 3 mm or any number or range including or within these values. The stop 285 should be designed to withstand applied brushing forces as well as forces which exceed the threshold high value force. For example, the stop 285 may be designed to withstand greater than about greater than about 4 Newtons, greater than about 5 Newtons of applied load, greater than about 6 Newtons, greater than about 7 Newtons, greater than about 8 Newtons, greater than about 9 Newtons, less than about 9 Newtons, less than about 8 Newtons, less than about 7 Newtons, less than about 6 Newtons, less than about 5 Newtons, or any number or range including or within these values.

Referring to FIGS. 2A and 4C, as shown, the electromagnetic source 250 may be disposed on the load member 230. When too high of a force is applied, the electromagnetic source 250 may be powered on, thereby supplying electromagnetic energy to the load member 230. In some embodiments, the load member 230 may transmit the electromagnetic energy from the electromagnetic source 250 to the indication element 30. In such embodiments, the load member 230 may be a light pipe, light guide, fiber optic, or the like. The material selected for the load member 230 may be clear, transparent, translucent or combinations thereof. Some suitable examples for the load member 230 include glass, polymethylmethacrylate, polycarbonate, copolyester, polypropylene, polyethyleneteraphthalate, combinations thereof, e.g. polyester and polycarbonate, or the like.

In some embodiments, the indication element 30 and the load member 230 may be unitary. For example, the load member 230 and the indication element 30 may be integrally constructed out of a first material during an injection molding process. In some embodiments, load member 230 may be a discrete part which is later connected to the indication element 30. In some embodiments, the indication element 30, the load member 230, the engagement section 316, first support 215, and/or second support 216 may be integrally formed. In some embodiments, the indication element 30, load member 230, and/or engagement section 316, may be integrally formed and subsequently attached to the first support 215 and/or second support 216. A benefit of such embodiments is that a reduced number of components are required for the brush which can reduce the cost and/or time of assembly.

The load member 230 may transmit electromagnetic energy, e.g. visible light, to the indication element 30 via internal reflection or external reflection. External reflections are reflections where the light originates in a material of low refractive index (such as air) and reflects off of a material with a higher refractive index (such as aluminum or silver). A common household mirror operates on external reflection.

Internal reflections are reflections where the light originates in a material of higher refractive index (such as polycarbonate) and reflects off of a material with lower refractive index (such as air or vacuum or water). Fiber optic technology operates on the principle of internal reflections.

Refractive index is an optic attribute of any material which measures the tendency of light to refract, or bend, when passing through the material. Even materials that do not conduct light (such as aluminum) have indices of refraction.

Typically, external reflections are most efficient when the angle of incidence of the light is near-normal (i.e., light approaches perpendicular to the surface) and degrade as the angle of incidence increases (approaches the surface at a steep angle). Conversely, internal reflections are most efficient at high angles of incidence and fail to reflect at shallow angles, e.g. normal to the surface. In order to achieve internal reflection, the angle of incidence should be greater than the critical angle. The critical angle is the angle below which light no longer reflects between a pair of materials.

Referring back to FIGS. 1 and 2A, for those embodiments of the present invention that utilize external reflection, a foil or some other highly reflective material can be utilized within the handle 12. The highly reflective material, e.g. foil, can be disposed on the interior surface of the handle 12. In other embodiments, the highly reflective material, e.g. foil can be wrapped around the load member 230. One downside to such embodiments is that additional manufacturing steps may be required in order to provide the highly reflective material to the appropriate location(s).

For those embodiments utilizing internal reflection, a material may be selected having high refractive index, e.g. above 1.0. For example, the material selected for the load member 230 may comprise a refractive index of greater than about 1.4, greater than about 1.5, greater than about 1.6, and/or less than about 1.7, less than about 1.6, less than about 1.5, or any number or ranges within or including the values provided. In some embodiments, the material selected for the load member 230 has a refractive index of between about 1.4 to about 1.6.

Referring to FIGS. 2A through 2B, in such embodiments, an outer surface 429 of the load member 230 may be polished. The polished outer surface 429 of the load member 230 can reduce the amount of leakage of light from the load member 230.

Referring to FIGS. 2A and 5A-5E, in some embodiments, the load member 230 may comprise a receptacle 553A, 553B, 553C, 553D for receiving the electromagnetic source 250. The receptacle 553A, 553B, 553C, 553D may be disposed on an end 555A, 555B, 555C, 555D of the load member 230. One benefit of implementing the receptacle 553A, 553B, 553C, 553D on the end 555A, 555B, 555C, 555D of the load member 230 is that during manufacturing, the electromagnetic source 250 may be inserted into the receptacle 553A, 553B, 553C, 553D thereby reducing the chance for misalignment of the electromagnetic source 250 with respect to the load member 230. This can help reduce the amount of leakage of light between the electromagnetic source 250 and the load member 230.

As stated previously, to achieve internal reflection, impinging light should be above the critical angle. The angle at which light impinges upon the load member 230 can be impacted by the distribution angle (discussed hereafter) of the electromagnetic source 250. For those output sources having a small distribution angle, the design of the receptacle 553A e.g. sides 557A and 557B perpendicular to face 557C, may be sufficient to capture the majority of light emitted from the electromagnetic source 250 for internal reflection. However, any light which is not above the critical angle will generally not be internally reflected. Accordingly, the receptacle 553B sides 559A, 559B and/or the face 559C may be configured to increase the amount of light which is above the critical angle. As shown, the face 559C may comprise an angle for increasing the angle of incidence of electromagnetic energy from the electromagnetic source 250. As another example, the receptacle 553C may comprise sides 551A, 551B and a face 551C which has an arcuate shape, e.g. lens. As yet another example, the receptacle 553D may comprise sides 549A, 549B, and a face 549C. The sides 549A and/or 549B may taper toward the face 549C. Combinations of these features are also contemplated. For example, a receptacle may comprise tapered sides tapered either toward the face or away therefrom and/or may comprise an angled face, an arcuate face, e.g. lens, or the like.

Figure 5A:
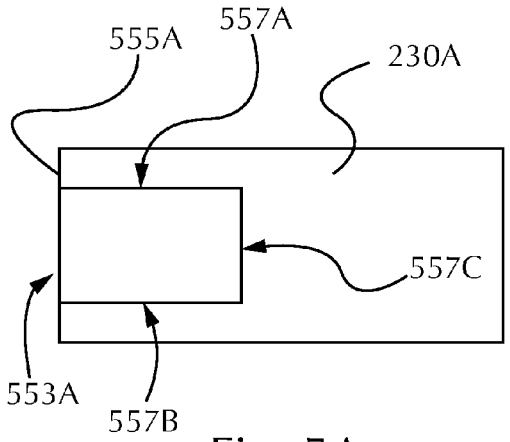
FIGS. 5A-5D are close up views showing various embodiments for receptacles of the load member for an electromagnetic source.
Figure 5B:
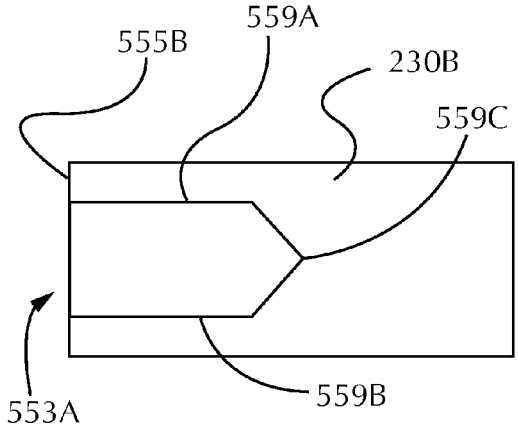
Figure 5C:
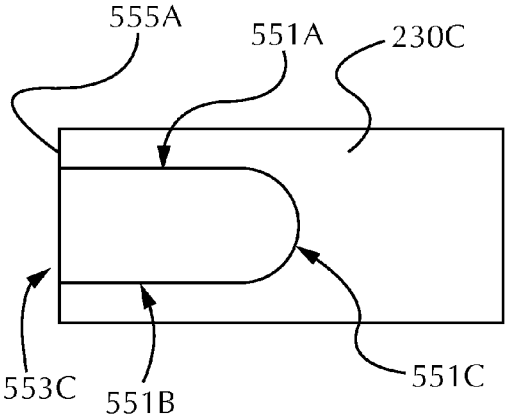
Figure 5D:
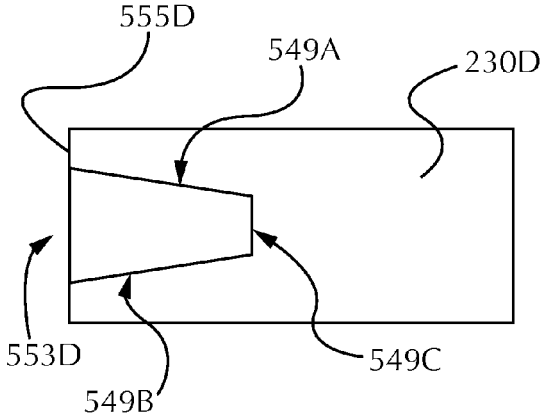
Figure 5E:
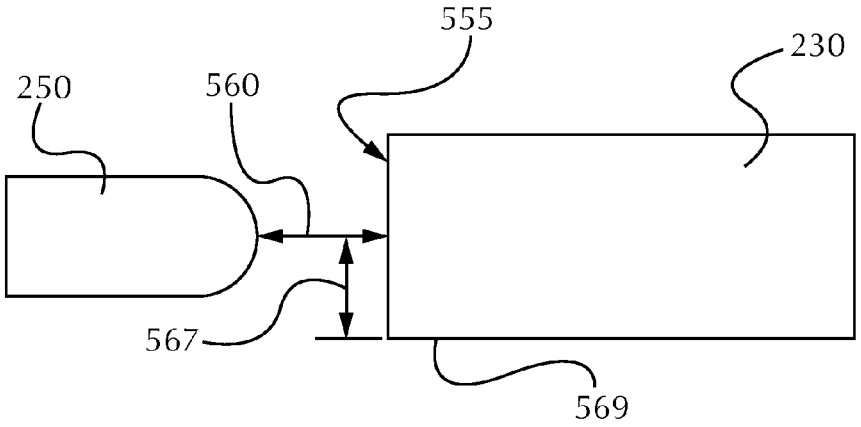
FIG. 5E is a close up view showing another embodiment of the load member where the electromagnetic source is not disposed within a receptacle.

Referring to FIG. 5E, in some embodiments, a load member 230 may be configured with a flat surface on an end 555. In such embodiments, the electromagnetic source 250, e.g. LED, may be positioned a distance 560 away from the end 555. In an effort to reduce the amount of light leaked from the output source 250, distance B (560) should generally be within the following guidelines.

$$B \leq \frac{A}{\tan(\alpha)}$$

Where α is the half angle α available from a manufacturer's specifications for an electromagnetic source, and where A (567) is a leg of projection on the load member 230. The leg of projection 567 is the straight line distance from the midpoint of the output source 250 projected onto the load member 230 to an edge 569 of the load member 230.

For those embodiments utilizing internal reflection, the distribution angle of the electromagnetic source 250, e.g. LED, should be considered. If the distribution angle is too broad, a portion of the light provided to the load member 230 may not be internally reflected and instead will be leaked out of the load member 230. Any suitable distribution angle may be utilized. Some examples of suitable distribution angles include greater than about 0 degrees, greater than about 1 degrees, greater than about 2 degrees, greater than about 5 degrees, greater than about 6 degrees, greater than about 8 degrees, greater than about 10 degrees, greater than about 12 degrees, greater than about 14 degrees, greater than about 16 degrees, greater than about 18 degrees, greater than about 20 degrees, greater than about 22 degrees, and/or less than about 22 degrees, less than about 20 degrees, less than about 18 degrees, less than about 16 degrees, less than about 14 degrees, less than about 12 degrees, less than about 10 degrees, less than about 8 degrees, or any number or any ranges within or including the values provided.

Figure 6A:
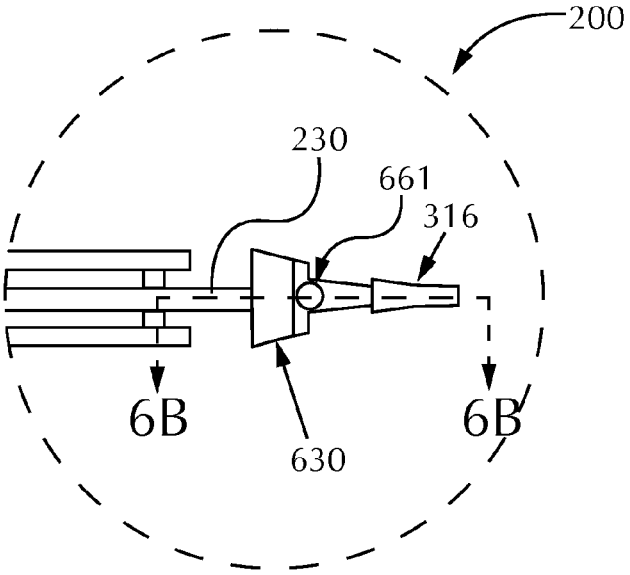
FIG. 6A is a close up view showing the proximal end of the insert of FIG. 2B with some features removed for ease of explanation.
Figure 6B:
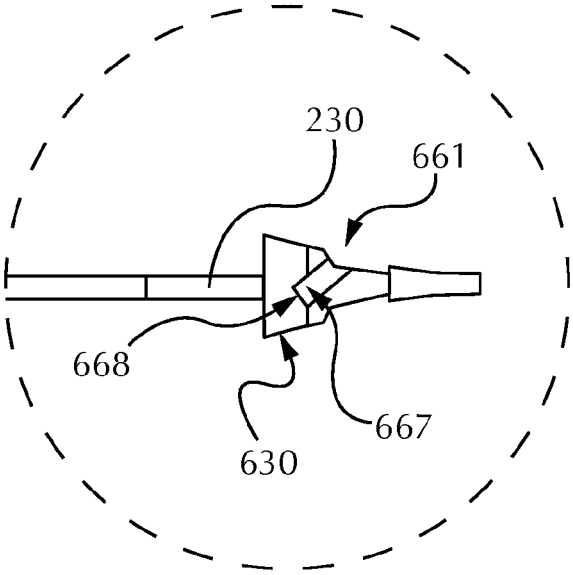
FIG. 6B is partial cross sectional view of the proximal end of the insert shown in FIG. 6A taken along line 6B-6B.

As stated previously, the load member 230 can transmit electromagnetic energy from the electromagnetic source 250, to the indication element 30. In an effort to reduce the amount of energy leaked through the engagement section 316, a reflective core 661 (shown in FIG. 6) may be utilized. For those embodiments where the neck 16 (shown in FIG. 1) and/or head 14 (shown in FIG. 1) are not detachable, a reflective core may be utilized in the neck 16 and/or head 14.

Referring to FIGS. 1 and 6A-6C, as shown, the reflective core 661 may be disposed in the indication element 30 and extend to the engagement section 316. The reflective core 661 can reduce the amount of light which is lost through the engagement section 316 and into the neck and/or head of the brush. Additionally, the reflective core 661 can assist in distributing light through the indication element 30 to a periphery 630 of the indication element 30. Also, in some embodiments, the reflective core 661 may be configured to assist in providing light to the first sealing element 70 and/or the second sealing element 75. In the embodiments where the first sealing element 70 and/or the second sealing element 75 are transparent or translucent, a unique visual effect may be created.

The reflective core 661 may comprise a polished area 667 having a face 668. The polished area 667 of the reflective core 661 is that portion of the reflective core 661 disposed within the indication element 30. The remainder of the reflective core 661 may be polished but it does not need to be. The polished area 667 can be configured to redirect light transmitted through the load member 230 to the indication element 30, the first sealing element 70 and/or the second sealing element 75.

Where the indication element 30 is a ring, e.g. the outer periphery 630 is circular the polished area 667 may be configured in the form of a cone (see FIG. 7A). As shown in FIG. 7B, where the indication element 30 comprises a ring, e.g. outer periphery 630 is circular, a polished area 667B may comprise a face 668B having multiple sides. As shown in FIG. 7C, an indication element 30C may comprise an outer periphery 630C having multiple sides. And, a polished area 667C may be configured in the form of a cone. As shown in FIG. 7D, an indication element 30D may comprise a periphery 630D having multiple sides. And, a polished area 667D may comprise a face 668D having multiple sides. The sides of the face 668D may be substantially parallel to the sides of the sides of the periphery 630D of the indication element 30D. As shown in FIG. 7E, an indication element 30E may comprise a periphery 630D having multiple sides, and a polished area 667E may comprise a face 668E having multiple sides. As shown, the sides of the face 668E may be arranged in a non-parallel fashion with the side of the outer periphery 630E of the indication element 30E. It is believed that such arrangements may produce a different visual effect than that of a polished area 667, 667C which is conical.

In some embodiments where the indication element does not extend to 360 degrees around the brush to form an outer surface of the brush, the polished area may be configured to distribute transmitted light to a portion of the indication element that is visible to the user. For example, where the indication element extends around the brush 90 degrees, the polished area may be configured as a portion of a cone which distributes light to the indication element.

Referring back to FIG. 6C, the reflective core 661 as shown can be a recess which remains empty in the final product. In some embodiments, the reflective core 661 may be partially filled with a material. Where the reflective core 661 is partially filled, an air gap between the filling material and the polished area 667 may be provided. The existence of this air gap can ensure that internal reflection is maintained within the indication element. In some embodiments, the reflective core 661 may be completely filled with material which has a lower refractive index than that of the material which forms the reflective core 661.

It is believed that without the reflective core 661 less than about 10 percent of the light provided by the electromagnetic source would be emitted by the indication element. And, it is believed that with the reflective core 661 about 90 percent or more of the light provided by the electromagnetic source would be emitted by the indication element, the first sealing element 70 and/or the second sealing element 75. In some embodiments, the light emitted by the indication element is greater than about 10 percent of the light provided by the electromagnetic source, greater than about 20 percent, greater than about 30 percent, greater than about 40 percent, greater than about 50 percent, greater than about 60 percent, greater than about 70 percent, greater than about 80 percent, greater than about 90 percent, less than about 100 percent, less than about 90 percent, less than about 80 percent, less than about 70 percent, less than about 60 percent, less than about 50 percent, less than about 40 percent, less than about 30 percent, less than about 20 percent, or any number or any ranges including and/or within the values above. A test method for measuring the light emission efficiency is discussed hereafter.

Figure 8A:
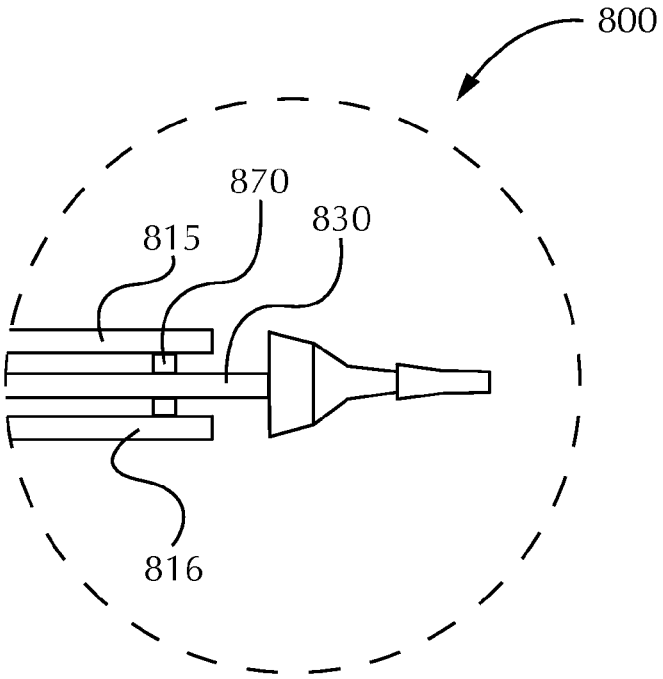
FIG. 8A is a close up view of a proximal end showing another embodiment for an insert.

In some embodiments, as shown in FIG. 8A, an insert 800 may comprise a load member 830 may be pivotally attached to a first support 815 and/or second support 816 similar to the insert 200. The insert 800 may further comprise an indication element, a power source, and an electromagnetic source as described herein and may be constructed similarly to the insert 200 except as described below.

The load member 830 may be pivotally attached to the first support 815 and/or second support 816 via a pivot support 870 instead of springs, e.g. 280 and 290 as discussed heretofore. The pivot support 870 can be fixedly attached to the first support 815 and/or the second support 816 such that the pivot support 870 cannot rotate with respect to the first support 815 and/or the second support 816. In such embodiments, the pivot support 870 may be rotationally fixed to the load member 830 such that the load member 830 may rotate with respect to the pivot support 870. Other configurations are contemplated. For example, the pivot support 870 may be fixed to the load member 830 such that the pivot support 870 cannot rotate with respect to the load member 830. In such embodiments, the pivot support 870 may be rotationally fixed with respect to the first support 815 and the second support 816.

For the embodiments where the pivot support 870 is rotationally coupled to the first support 815 and the second support 816, the pivot support 870 may be integrally formed with the load member 830. For the embodiments where the pivot support 870 is rotationally coupled to the load member 830, the pivot support 870 may be integrally formed with the first support 815 and/or the second support 816.

Figure 8B:
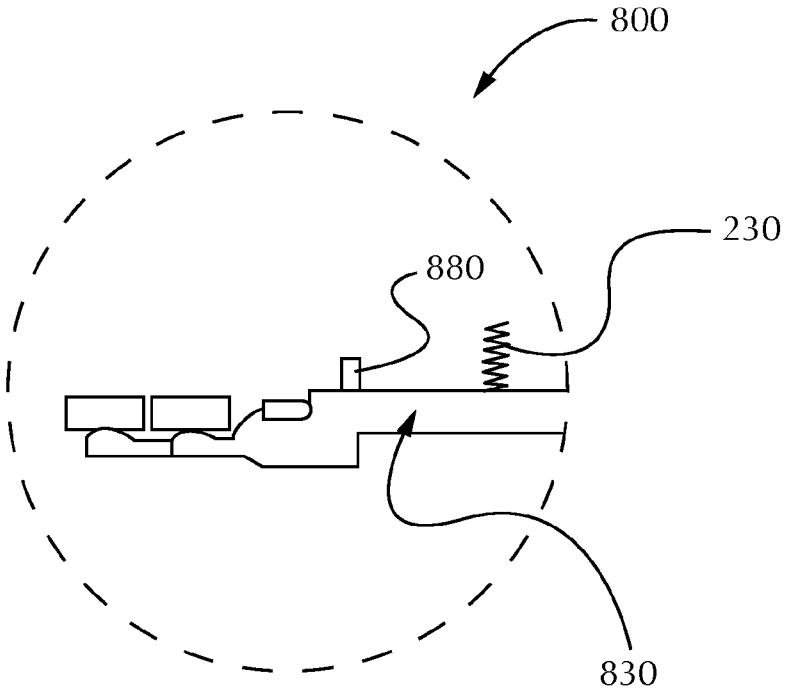
FIG. 8B is a close up view of a distal end of the insert of FIG. 8A.

For such embodiments, the pivot support 870 may be configured to offer little to no resistance to the rotation of the load member 830. Accordingly, a resistance element may be utilized. As shown in FIG. 8B, the load member 830 may comprise a stop 880 similar to the stop 285 discussed heretofore with regard to insert 200. Additionally, the load member 830 may comprise a resilient member 890, e.g. spring. The resilient member 890 may be configured such that an applied load to the contact element field causes the resilient member 890 is compressed. Alternatively, the resilient member 890 may be configured such that an applied load to the contact element field causes the resilient member 890 to be elongated. Still in other embodiments, more than one resilient member may be utilized such that an applied load causes one resilient member to elongate and one to compress.

Figure 9:
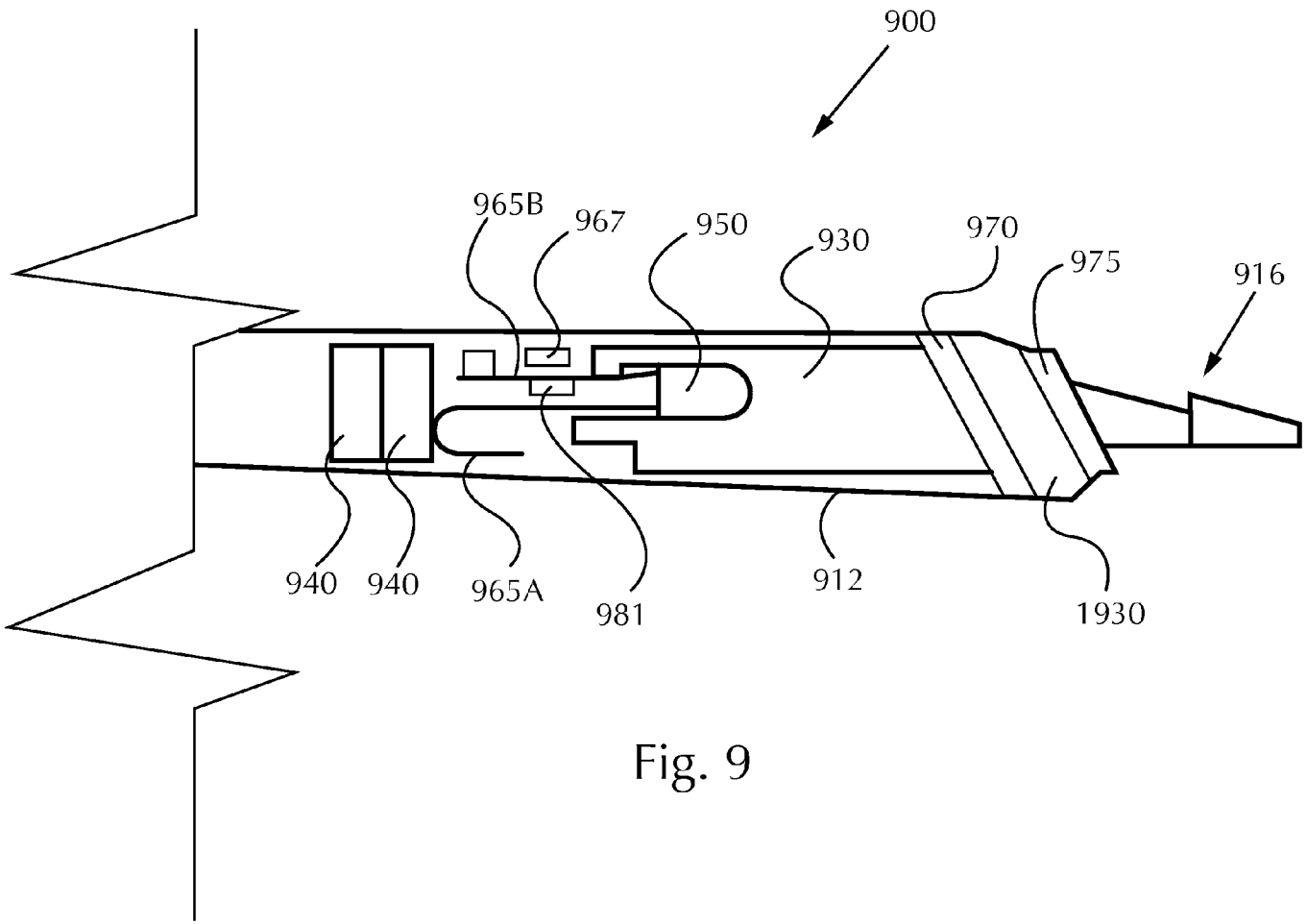
FIG. 9 is a partial cross sectional view showing another embodiment for an insert of the present invention.

In some embodiments, as shown in FIG. 9, an insert 900 may comprise a load member 930 which is pivotally attached to a handle 912. The insert 900 may further comprise a first sealing element 970 and a second sealing element 975 which may be configured as discussed with regard to the first sealing element 70 and the second sealing element 75. Additionally, the insert 900 may comprise an engagement portion 916 which can be configured similarly to the engagement portion 316. The insert 900 may further comprise an indication element 1930 for providing visible signals to a user. In some embodiments, the engagement portion 916, the indication element 1930, and/or the load member 930 may be integrally formed.

The load member 930 may comprise a receptacle as described heretofore which can accommodate an electromagnetic source 950, e.g. LED. The electromagnetic source 950 may comprise contacts 965A and 965B which can provide electrical communication between the electromagnetic source 950 and power supply 940 when too much force is applied by a user.

Similar to the configuration shown in FIGS. 8A and 8B, the load member 930 may be pivotally mounted via pivot support which provides little to no resistance to the rotation of the load member 930. As shown, a contact, e.g. 965B may be utilized as the spring which provides resistance to the movement of the load member 930. For example, as shown, when a force is applied to the contact element field which causes the load member 930 to pivot with respect to the handle 912, the contact 965B may tend to move toward a contact base 967. In some embodiments, a support base 981 integral with the load member 930 may be utilized to effect the appropriate bending of the contact 965B when too high of a force is applied.

The load members 830 and 930 may be configured similar to the load member 230 described heretofore. For example, the load members 830 and 930 may transmit electromagnetic energy to their respective indication elements via internal reflection or external reflection. Additionally, the inserts 800 and 900 may be constructed similar to the insert 200. For example, their respective indication elements may comprise a reflective core as described herein.

Figure 17A:
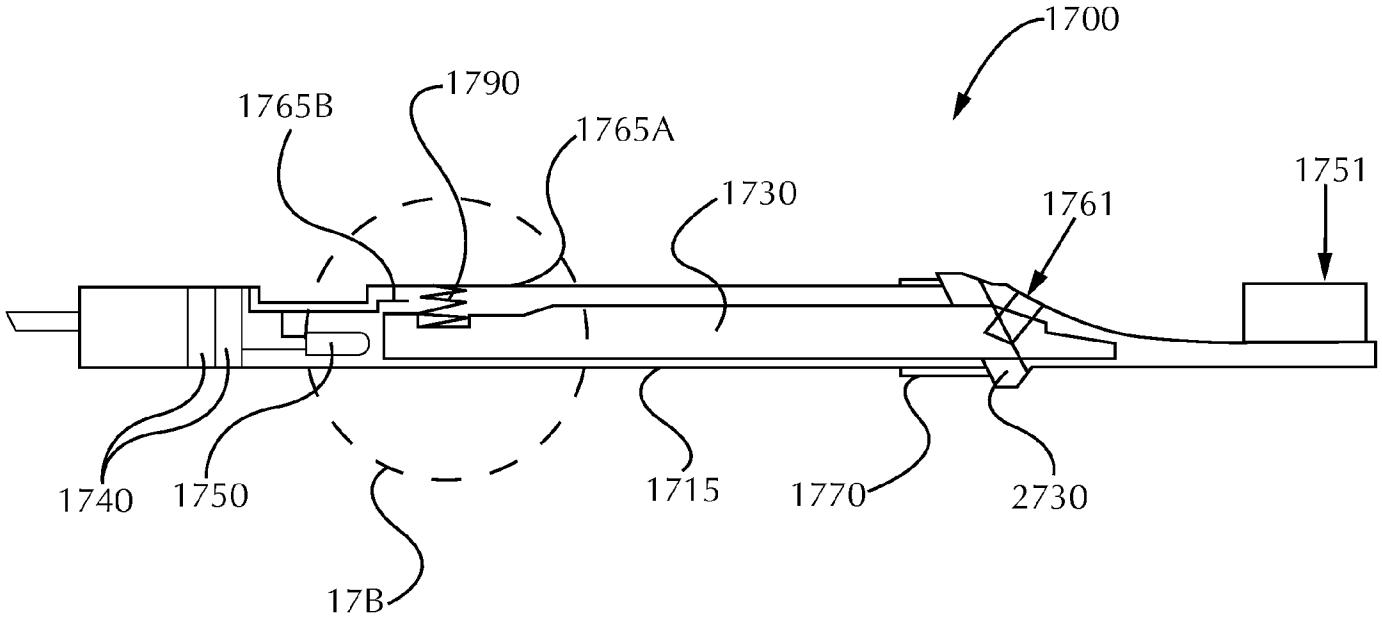
FIG. 17A is a cross sectional view showing another embodiment of an oral hygiene implement constructed in accordance with the present invention.

In some embodiments, as shown in FIG. 17A, a toothbrush may comprise an insert 1700 having a load member 1730 which is pivotally attached to a support 1715. The pivot connection between the load member 1730 and the support 1715 may be configured such that little resistance to motion, if any, exists. The load member 1730 may be constructed similarly to the load members 230, 830, and 930. As shown, the load member 1730 may comprise an indication element 2730. The indication element 2730 may comprise an elastomeric material which is injection overmolded onto the load member 1730. Additionally, a sealing element 1770 may be integrally formed with the indication element 2730. The sealing element 1770 may engage an inner surface of a handle to prevent or reduce the likelihood of water and/or other contaminants from entering the cavity of the handle.

In such embodiments, the indication element 2730 may comprise a translucent or transparent material to allow electromagnetic energy from an electromagnetic source 1750 to be provided to the user. Additionally, unique color combinations may be created by utilizing a colored material for the indication element 2730. For example, the electromagnetic source 1750 may provide an electromagnetic output of a first color while the indication element 2730 may comprise a second color. The first color may be different from the second color, e.g. blue and yellow, respectively. As another example, the indication element 2730 may comprise a complimentary color. The indication element 2730 may be a first color and the electromagnetic source may emit electromagnetic energy comprising primarily the first color, e.g. red and red.

In operation, the load member 1730 pivots with respect to the support 1715 when an applied load 1751 exceeds a certain threshold limit. As shown, a resilient element 1790 may be positioned between a first contact 1765A and the load member 1730. The resilient element 1790 may be appropriately sized such that the load member 1730 does not pivot with respect to the support until a first threshold force is applied. For example, in some embodiments, the resilient member 1790 may be applied to provide a pre-stress on the load member of about 3.2 Newtons. In such embodiments, the load member 1730 would not pivot with respect to the support 1715 until the applied force 1751 exceeded about 3.2 Newtons. When the applied force 1751 exceeds the first threshold force, the load member 1730 pivots with respect to the support 1715. As an example, if the applied force 1751 meets or exceeds about 5 Newtons, then the load member 1730 moves a second contact 1765B into contact with the first contact 1765A. The first contact 1765A and the second contact 1765B may be in electrical communication with a power supply 1740 such that when the first contact 1765A and the second contact 1765B are in contact, a circuit powering the electromagnetic output 1750 is energized.

The second contact 1765B may be configured to provide little to no resistance to the motion of the load member 1730. Alternatively, the second contact 1765B may be configured to provide some resistance to this motion in addition to the resilient element 1790.

Similar to the load members discussed heretofore, the load member 1730 may comprise a reflective core 1761. The reflective core 1761 may be constructed similar to the reflective cores discussed herein. Similarly, the load member 1730 may comprise a stop as described heretofore with regard to FIGS. 8A and 8B.

Figure 17B:
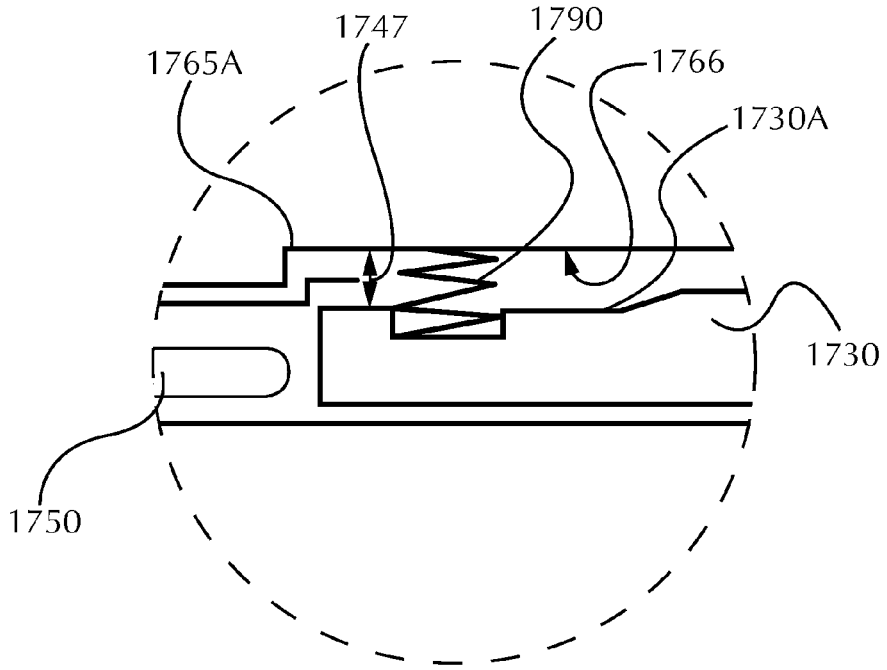
FIG. 17B is a close up view showing the cross section of the oral hygiene implement of FIG. 17A.

Referring to FIGS. 17A and 17B, a distance 1741 between a first surface 1730A of the load member 1730 and an inner surface 1766 of the first contact 1765A can be any suitable distance. For example, the distance 1741 can be greater than about 0.3 mm to about 1.3 mm. In some embodiments, the distance 1741 may be greater than about 0.3 mm, greater than about 0.4 mm, greater than about 0.5 mm, greater than about 0.6 mm, greater than about 0.7 mm, greater than about 0.8 mm, greater than about 0.9 mm, greater than about 1.0 mm, greater than about 1.1 mm, greater than about 1.2 mm, less than about 1.3 mm, less than about 1.2 mm, less than about 1.1 mm, less than about 1.0 mm, less than about 0.9 mm, less than about 0.8 mm, less than about 0.7 mm, less than about 0.6 mm, less than about 0.5 mm, less than about 0.4 mm or any number or range including or within the values provided. In some embodiments, the distance 1741 is about 0.8 mm.

The pre-stressing of the load member 1730 such that the pivot motion does not begin until after an applied force 1751 of about 3.2 Newtons is important from a tolerance based perspective in addition to the distance 1741. As an example, if indication of too high of an applied force is to be provided to the user at the applied force 1751 of about 5 Newtons, the load member 1730 may be pre-stressed by about 3.2 Newtons, and the distance 1741 between the first surface 1730A and the inner surface 1766 may be about 0.7 mm. In such embodiments, the 0.7 mm distance 1741 corresponds to 1.8 Newtons or 2.5 N/mm. In contrast, with no pre-loading, the 0.7 mm distance 1741 corresponds to 5 Newtons or 7.1 N/mm. For both examples, a tolerance of plus/minus 0.2 mm can lead force indication variances. However, for the first example, a plus 0.2 mm to the distance 1741 means an indication of too high of an applied force at about 5.5 Newtons. For the second example, a plus 0.2 mm means an indication at about 6.4 Newtons. For a tolerance of minus 0.2 mm to the distance 1741 in the first example with pre-loading of 3.2 N, indication of too high of an applied force would occur at an applied force of about 4.5 Newtons. In the second example, a tolerance of minus 0.2 mm to distance 1741 in the second example with no pre-loading the indication of too high of an applied force would occur at about 3.55 Newtons. So, pre-loading can be beneficial when trying to reduce tolerance based variances in force indication.

The amount of pre-loading can be any suitable force. For example, in some embodiments, pre-loading can be greater than about 2 Newtons, greater than about 3 N, greater than about 3.2 N, greater than about 3.4 N, greater than about 3.6 N, greater than about 3.8 N, greater than about 4.0 N, greater than about 4.2 N, greater than about 4.4 N, greater than about 4.6 N, greater than about 4.8 N, less than about 5 N, less than about 4.8 N, less than about 4.6 N, less than about 4.4 N, less than about 4.2 N, less than about 4.0 N, less than about 3.8 N, less than about 3.6 N, less than about 3.4 N, or any number or range including or within these values. In some embodiments, the pre-loading is about 4 N.

In some embodiments, the tolerance based variance is less than about 20 percent of the indication value. For example, if the indication value is about 5 Newtons, the tolerance based variance is less than about 1 Newton. In some embodiments, the tolerance based variance is less than about 15 percent of the indication value, less than about 10 percent of the indication value, less than about 5 percent of the indication value or any number or range including or within these values.

At least one benefit of the embodiments FIGS. 8A, 8B, 9, and 17A-17B is the customizability of the inserts 800, 900, and 1700. Since a resilient member, e.g. spring 890, 1790 and contact 965B, are utilized as the main sources or resistance to the motion of the respective load members 830, 930, 1730 the inserts may be utilized ubiquitously with little modification. For example, a first brush head may require that a force threshold of 2.5 Newtons is exceeded before a signal is provided to the user that the applied brushing force is too high. In contrast a second brush head may require that a force threshold of 3.5 Newtons is exceeded before a signal is provided to the user that the applied brushing force is too high. Because of the modular nature of the inserts 800, 900, and 1700, modification of the resilient member 890, 1790 and contact 965B, between the first brush head and the second brush head can provide the correct force thresholds for the two brushes. Accordingly, during manufacturing of the brushes, one can customize the inserts as required for a given brush head such that the appropriate force threshold is supplied by the insert.

In order to increase reliability during the manufacture of the brushes of the present invention, consideration should be given to the materials on the brush which can create an opposing force to the applied brushing force. For example, the first sealing element 70, the second sealing element 75, and/or the sealing element 1770 can provide some resistance to the movement of the load member. As such, in some embodiments, the material for the sealing elements is selected to be of a shore A hardness of the less than about 50. Similarly, the sealing element 1770 may have a reduced cross sectional area adjacent to the indication element 2730 thereby reducing the impact that the sealing element 1770 has on any opposing force to the applied brushing force.

Figure 10A:
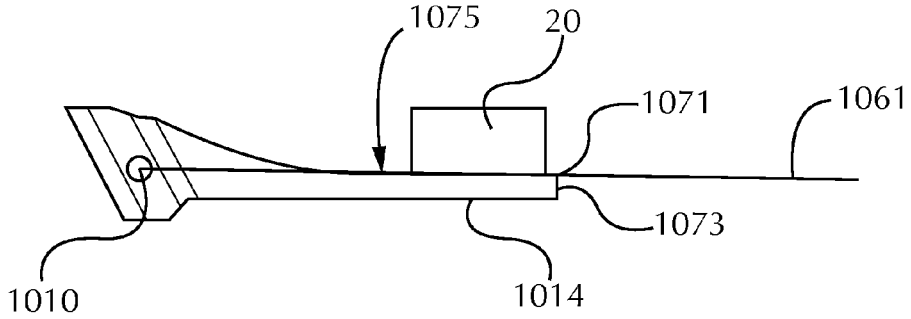
FIGS. 10A-10C show a neck and head for use with the present invention.
Figure 10B:
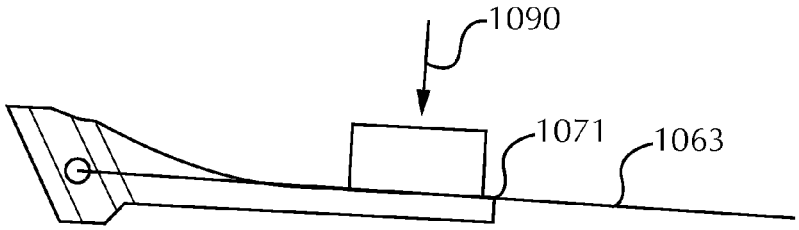
Figure 10C:
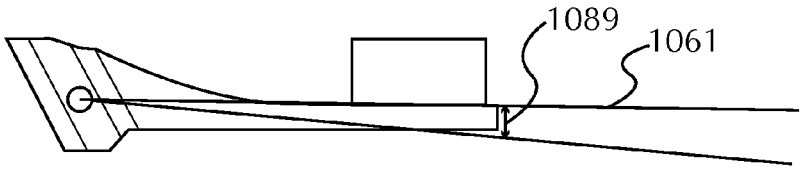

It has been discovered that with regard to toothbrushes, consumers tend to dislike a substantial amount of movement in the area of the toothbrush head. Specifically, consumers tend to dislike too much movement of the toothbrush head in a plane which is generally perpendicular to a pivot axis 1010 (shown in FIG. 10A). Referring to FIGS. 10A through 10C, the movement of the head 1014 in this plane can be determined by measuring a straight line distance 1089 between an at rest plane 1061 and an applied force plane 1063 where the straight line 1089 is orthogonal to the at rest plane 1061 and is tangent to the toothbrush head 1014 at an intersection 1071.

The at rest plane 1061 extends through the pivot axis 1010 and extends through the intersection 1071 between a side 1073 and a first face 1075 of the toothbrush head 1014. Where the intersection 1071 includes a rounded edge, the point of intersection between the side 1073 and the first surface 1075 shall be the bisection of the rounded edge. The at rest plane 1061 is referenced while there is no load on the contact element field 20.

The applied force plane 1063, similar to the at rest plane 1061, extends through the pivot axis 1010 and extends through the intersection 1071. The applied force plane 1063 is referenced while there is a predetermined applied load 1090 applied to the cleaning element field 20. The predetermined applied load 1090 is 5 Newtons.

In some embodiments, the straight line distance 1089 may be less than about 6 mm, less than about 5 mm, less than about 4 mm, less than about 3 mm, less than about 2 mm, less than about 1 mm and/or greater than about 1 mm, greater than about 2 mm, or any number or range including or within the values provided.

While heretofore, the condition for which a signal is provided to the user is with regard to a too high of an applied brushing force, signals for other conditions or additional conditions may be provided to the user. For example, a signal can be provided to the user regarding the application of too high of a brushing force being utilized; however, in addition, at least one of the following conditions may similarly be indicated to the user: (1) too little force is being applied; (2) a sufficient force is being applied; (3) too much force is being applied, within a range just above sufficient force; (4) a much higher force is being applied (much higher than suitable force); (5) an upper limit for too high of a force being applied has been reached; (6) a lower limit for too low of a force being applied has been reached.

In some embodiments, combinations of signals can be utilized for any combination of conditions. For example, to signal the user that too little force is being applied a first signal may be audible while a second signal signifying too much force may be visual. Any suitable combinations of signals can be utilized. As yet another example, to signal the user that too little force is being applied a first signal may be visual and comprise a first color while a second signal signifying too much force may similarly be visual but comprise a second color which contrasts with the first color. Any suitable colors may be utilized, e.g. red, green, yellow, blue, purple, the like, or combinations thereof. Such combinations of signals may also be applied where the electromagnetic source is configured to provide a signal for a sufficient force and/or upper and lower values thereof.

Several considerations can be taken into account when trying to evaluate the above conditions. For example, mouth feel, cleaning efficacy, etc. With regard to mouth feel, for example, oral care implements comprising cleaning elements which are very soft can generally provide a comfortable mouth feel to a user at forces which are higher than those oral care implements having more stiff cleaning elements. As another example, cleaning elements which comprise elastomeric materials may be more comfortable for a user and therefore may allow a higher force to be applied during brushing while still being within the user's comfort level. With regard to efficacy, cleaning elements having surface features, as described in U.S. Pat. Nos. 5,722,106; 5,836,769; 6,058,541; 6,018,840; U.S. Patent Application Publication Nos. 2006/0080794; 2006/0272112; and 2007/0251040; and PCT Publication No. WO2011/093874 may require a lower force during brushing to provide sufficient cleaning/plaque removal when compared to/cleaning elements having smooth surface features.

Another consideration which can be taken into account includes clinical safety. For example, a force which provides good mouth feel to consumer may cause gum irritation, gum recession, and/or tooth enamel abrasion.

Several variables can affect the considerations above, e.g. mouth feel, cleaning efficacy, clinical safety. For example, users may apply a specific brushing force while utilizing a powered toothbrush and a different force while utilizing a manual toothbrush. As another example, length of the cleaning elements, cross sectional shape of the cleaning elements, e.g. diameter, bending properties, etc. Because of the numerous variables which can impact the above considerations, consumer testing, clinical testing, and/or robot testing may be utilized to empirically determine values for: (1) too little force being applied; (2) too much force being applied; and/or (3) sufficient force being applied; (4) a low end of the sufficient force range being applied; and/or (5) a high end of the sufficient force range being applied, which can still provide comfortable mouth feel, cleaning efficacy, and clinical safety.

User testing and/or clinical testing may provide some insight as to an appropriate value for the upper end of the tolerance of a sufficient force for a particular brush and/or an appropriate value for the lower end of the tolerance of the sufficient force for the particular brush. In general, users can try a particular toothbrush and apply a prescribed force while brushing. For example, brushes of the present invention may be utilized to signal to the user when the prescribed force was reached, exceeded, and/or not met. After brushing, the users may be asked to provide feedback with regard to the feel of the brush in the oral cavity. Additionally, plaque scans can be taken of the oral cavities of consumers prior to brushing and then post brushing. Comparison can be made of the before and after in order to determine efficacy at a particular force. Moreover, clinical testing can be performed on the upper end of the range of the sufficient force to determine whether gum irritation, gum recession, and/or tooth enamel abrasion occurs at this value. Via iterative testing, the appropriate values for force thresholds during brushing for a variety of brush heads.

Similarly, robot testing may be utilized to determine efficacy of a particular brush at a given force. In robot testing, generally, a toothbrush is operated by a robot arm which moves the toothbrush in a brushing motion across teeth of a model of an oral cavity. Generally, the teeth of the model are covered by a synthetic plaque which is well known in the art. The robot arm can apply a predetermined force to the toothbrush during the simulation. After the simulation, plaque analysis before brushing and after brushing can be compared. From the before and after plaque analysis, a cleaning/efficacy determination can be made. Through iteration, the lower level of sufficient force range may be determined for any cleaning element/massaging element configuration.

Each of consumer testing, clinical testing, and robot testing can provide useful information on the values of force associated with the conditions: (1) too little force being applied; (2) too much force being applied; and/or (3) a sufficient force being applied; (4) a lower end of the sufficient force range being applied; and/or (5) an upper end of the sufficient force range being applied, which can still provide comfortable mouth feel as well as cleaning efficacy.

In some embodiments, a value of too much applied brushing force may be greater than or equal to about 1 Newton, 1.25 Newtons, 1.5 Newtons, 1.75 Newtons, 2.00 Newtons, 2.10 Newtons, 2.20 Newtons, 2.30 Newtons, 2.40 Newtons, 2.50 Newtons, 2.60 Newtons, 2.75 Newtons, 2.85 Newtons, greater than or equal to about 3.00 Newtons, greater than or equal to about 3.50 Newtons, greater than or equal to about 3.75 Newtons, greater than or equal to about 4.00 Newtons, greater than or equal to about 4.25 Newtons, greater than or equal to about 4.50 Newtons, greater than or equal to about 4.75 Newtons, greater than or equal to about 5.00 Newtons, greater than or equal to about 5.25 Newtons, greater than or equal to about 5.50 Newtons, greater than or equal to about 5.75 Newtons, or greater than or equal to about 6.00 Newtons. In some embodiments, a value of too little force being applied may be less than or equal to about 5.00 Newtons, about 4.75 Newtons, about 4.5 Newtons, about 4.25 Newtons, about 4.00 Newtons, about 3.75 Newtons, about 3.5 Newtons, about 3.25 Newtons, about 3.00 Newtons, about 2.75 Newtons, about 2.50 Newtons, about 2.25 Newtons, about 2.00 Newtons, about 1.75 Newtons, about 1.50 Newtons, about 1.25 Newtons, about 1.00 Newtons, about 0.75 Newtons, or about 0.50 Newtons. In some embodiments, values for a low end of a sufficient force range, an upper end of the sufficient force range, and/or the sufficient force range may be selected from any of the values provided above with regard to the too much force and/or too little force conditions.

The signal provided to the user may be constant, e.g. provide a signal to the user in real time during the entire brushing routine. Alternatively, the signal provided to the user can be provided at the end of the brushing routine. For example, where the user applied too high of a force during the majority of brushing routine, the signal provided to the user may flash a first color or show the first color for a predetermined time period. As another example, where the user applied too low of a force during the majority of the brushing routine, the signal provided to the user may flash a second color or show the second color for a predetermined period of time. As yet another example, where the user applied a sufficient force during the majority of the brushing routine, the signal provided to the user may flash a third color or show the third color for a predetermined period of time. As described heretofore, combinations of various signals may be utilized.

In other embodiments, the signal can be provided to the user intermittently during the brushing routine. For example, the signal can be provided to the user on predetermined time intervals. For example, a signal may be provided to the user every 20 seconds. Any suitable time interval can be selected. For example, the time interval between signals can be greater than about 0.1 second, greater than about 0.2 seconds, greater than about 0.3 seconds, greater than about 0.4 seconds, greater than about 0.5 seconds, greater than about 0.6 seconds, greater than about 0.7 seconds, greater than about 0.8 seconds, greater than about 0.9 seconds, greater than about 1 second, greater than about 2 seconds, greater than about 3 seconds, greater than about 4 seconds, greater than about 5 seconds, greater than about 6 seconds, greater than about 10 seconds, greater than about 15 seconds, greater than about 20 seconds, greater than about 25 seconds, greater than about 30 seconds, greater than about 40 seconds, greater than about 50 seconds, greater than about 60 seconds, and/or less than about 60 seconds, less than about 50 seconds, less than about 40 seconds, less than about 30 seconds, less than about 25 seconds, less than about 20 seconds, less than about 15 seconds, less than about 10 seconds, less than about 5 seconds, less than about 4 seconds, less than about 3 seconds, less than about 2 seconds, less than about 1.5 seconds, less than about 1, less than about 0.9 seconds, less than about 0.8 seconds, less than about 0.7 seconds, less than about 0.6 seconds, less than about 0.5 seconds, less than about 0.4 seconds, less than about 0.2 seconds, or less than about 0.1 seconds or any number or any range within or including these values.

Toothbrushes of the present invention may further comprise a processor. The processor may be in signal communication with the load member and the electromagnetic source. The processor may be utilized to log the performance of the user for the duration of the brushing regimen. For example, the user may brush for a predetermined time period, e.g. two minutes, after such time period the processor may cause the electromagnetic source to provide the user with a signal that a sufficient force was applied for the duration of the two minute period. As another example, the processor may cause the electromagnetic source to provide the user with a signal that a sufficient force was applied for about half of the two minute period. As yet another example, the processor may cause the electromagnetic source to provide the user with a signal that a high force was applied for all and/or more than fifty percent of the two minute period. As yet another example, the processor may cause the electromagnetic source to provide the user with a signal that a low force was applied for all and/or more than fifty percent of the two minute period. The signals provided to the user may include those signals previously described herein.

Additionally, the processor may be useful in eliminating force spikes from indication. In such embodiments, the processor may serve as a buffer for the electromagnetic source by building in a time delay between occurrence of the condition and the provided signal by the electromagnetic source. For example, the processor may be configured to include a five second time delay such that an applied brushing force which is too high must remain too high for at least five seconds before the processor causes the electromagnetic source to provide a signal to the user. Configured as such, the processor may filter the input from the load member such that the electromagnetic source does not cause a plurality of flashing signals to the user. The time delay may be any suitable delay. For example, in some embodiments, the time delay may be less than about 10 seconds, less than about 9 second, less than about 8 second, less than about 7 second, less than about 6 second, less than about 5 seconds, less than about 4 seconds, less than about 3 seconds, less than about 2 seconds, less than about 1 second, less than about 0.75 seconds, less than about 0.5 seconds, less than about 0.25 seconds, less than about 0.10 seconds.

Other suitable mechanisms to reduce and/or eliminate force spikes may be utilized. For example, in some embodiments a low pass filter of at least the first order may be utilized. In such embodiments, the low pass filter may preclude a force spike from causing the electromagnetic source to provide an output because of the high frequency of the force spike. As another example, the processor may be programmed to include a digital filter which can eliminate force spikes from causing the electromagnetic source to provide an output. Force spike filtration is further described in U.S. Pat. No. 7,120,960.

Previously, a time interval between signals was discussed. In some embodiments, the processor may be configured to modify the time interval between the signals provided to the user either during a particular brushing routine or over a series of brushing routines. For example, during a first brushing routine, if the user alternates between utilizing too much force and/or too little force, the interval between signals to the user may be at a first time interval. However, if in the first brushing routine, the user also utilizes a force which is within the sufficient force range, the signals to the user may be at a second time interval. In such an embodiment, the first time interval may be less than the second time interval thereby providing more feedback to the user. In some embodiments, the time intervals may be switched such that the user if provided more feedback for forces which are within the predetermined sufficient force range.

As stated previously, the processor may similarly modify the time interval between signals provided to the user over a series of brushing routines. For example, during a first brushing routine, the user may apply too much force and/or too little force for a majority of a time period of the first brushing routine. During the first brushing routine, the time interval between signals may be at a first time interval. The processor may be configured to process data regarding applied force during the first brushing routine and modify the time interval for the next brushing routine. For example, for a second brushing routine, based upon the data of the first brushing routine, the processor may modify the time interval between signals during the second brushing routine to a second time interval. The second time interval may be less than the first time interval such that the user may be provided more feedback during the second brushing routine. If during the second brushing routine, the user, for a majority of the time period of the second brushing routine, applies a force within a range of sufficient force, then the processor may modify the time interval between signals for a third brushing routine. For example, the time interval between signals for the third brushing routine may be less than the second time interval. However, if during the second time interval, the user applies, for a majority of the second brushing routine a force which is too high and/or too low for a majority of the time period of the second brushing routine, then the processor may adjust the time interval between signals for the third brushing routine to be less than the second time interval such that the user may be provided with even more feedback than in the second brushing routine. In some embodiments, the processor may be configured to provide more feedback with regard to a force within the range of sufficient force at increasing and/or decreasing time intervals.

The electromagnetic source may comprise a plurality of visual components, e.g. LEDs. The use of at least one light source and/or a plurality of light sources to provide feedback to the user is discussed in more detail in U.S. Pat. No. 7,120,960 and PCT application serial number IB2010/051194, entitled "Electric Toothbrush and Method of Manufacturing an Electric Toothbrush", filed on Mar. 18, 2010. As discussed previously, the toothbrushes of the present invention may comprise a processor. In such embodiments, the processor may be in electrical communication with the electromagnetic output source such that the processor may control the output of the electromagnetic output source.

In some embodiments, a receptacle (discussed heretofore) of a load member may be configured such that two LEDs may be positioned therein. A first LED may provide a first output signal for one condition, e.g. brushing time, while a second LED may provide a second output signal for a second condition, e.g. time for brush replacement, wherein the first output signal and the second output signal are different. Similarly, in embodiments where the transmission element does not include a receptacle, a plurality of output sources, e.g. LEDs, may be utilized.

Figure 11A:
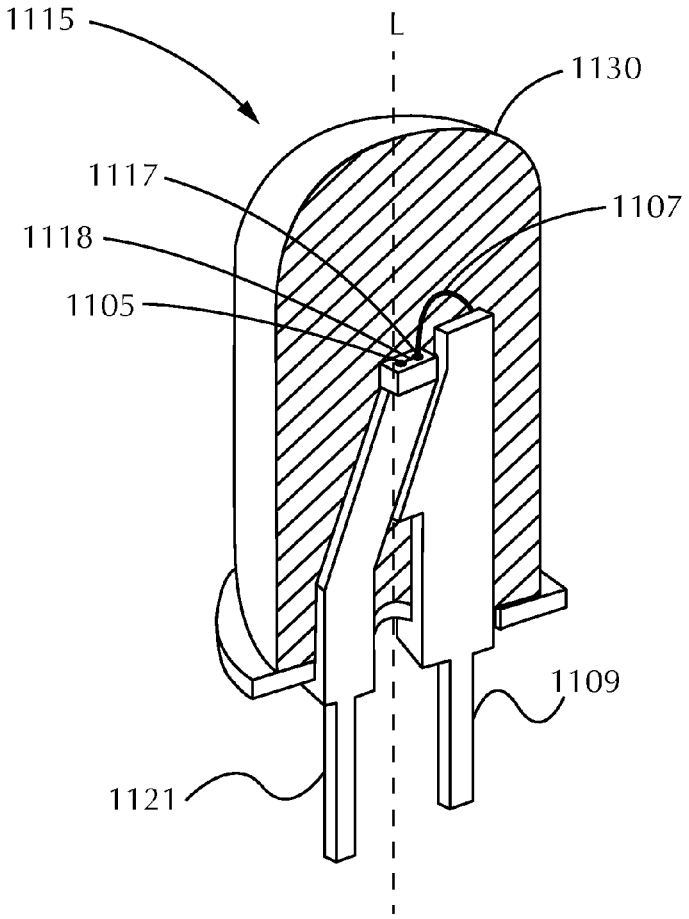
FIGS. 11A-11D are cross sectional views of exemplary LEDs which are suitable for use with the oral hygiene implement of the present invention.

Instead of a plurality of LEDs, embodiments are also contemplated where the output source comprises an LED having multiple dices as described in U.S. Patent Application Publication No. 2005/0053896A1. As shown in FIG. 11A, an LED 1115 may include a lens 1130, and one negative lead 1121 and one positive lead 1109. The LED 1115 may comprise more than one light emitter and more than one semi-conductor substrate, and can have more than two leads. Embodiments are contemplated where the LED comprises two dices. Additionally, embodiments are contemplated where the LED comprises more than two dices.

For example, the LED 1115 may comprise multiple light emitting dices 1105 and 1117 and a wire bonding 1107 and 1118. The wire bonding 1118 may serve as the connection between the dices 1105 and 1117. This connection can be either a parallel connection or a serial connection.

Figure 11B:
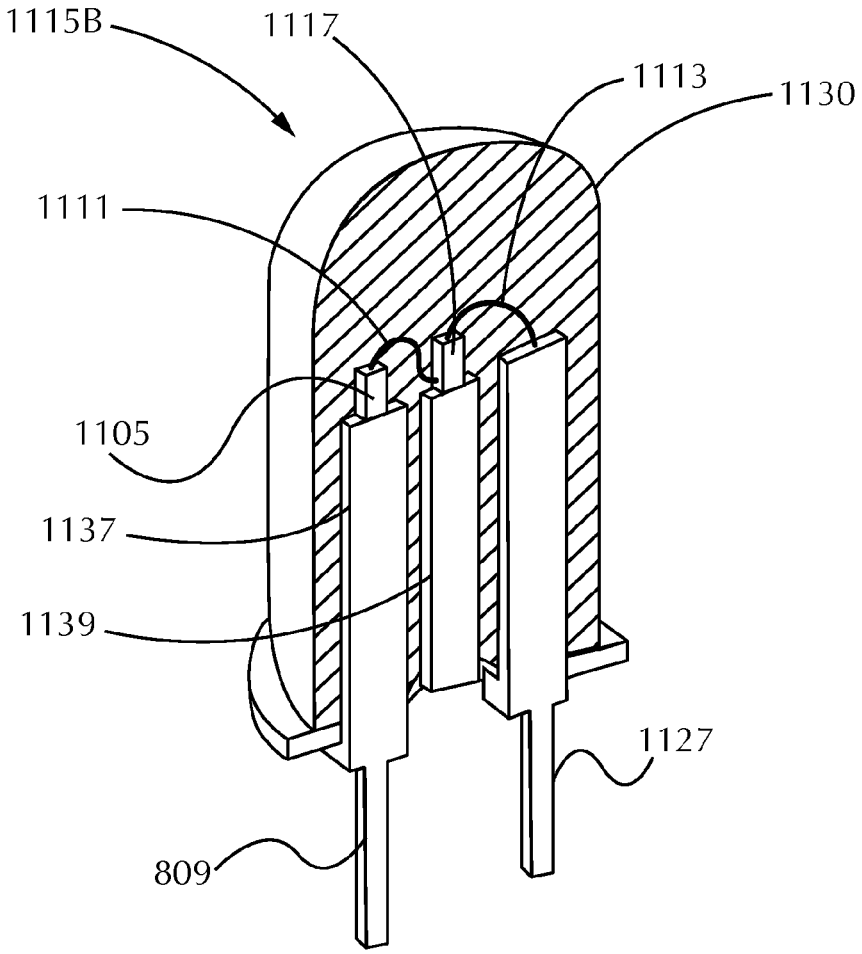

As shown in FIG. 11B, an LED 1115B (two wire LED) may comprise multiple dices 1105 and 1117 connected in series. The LED 1115B may include one positive lead 1109 and one negative lead 1127. As shown, each dice 1105 and 1117 may have an individual pedestal 1137 and 1139. The dices have a serial connection 1111 connecting the top of dices 1105 to the bottom of dices 1117, and wire bonding 1113 connects the top of dices 1117 to the negative lead 1127. All light from the light emitting sources may be combined to result in a single light output at lens 1130 of LED 1115B.

Figure 11C:
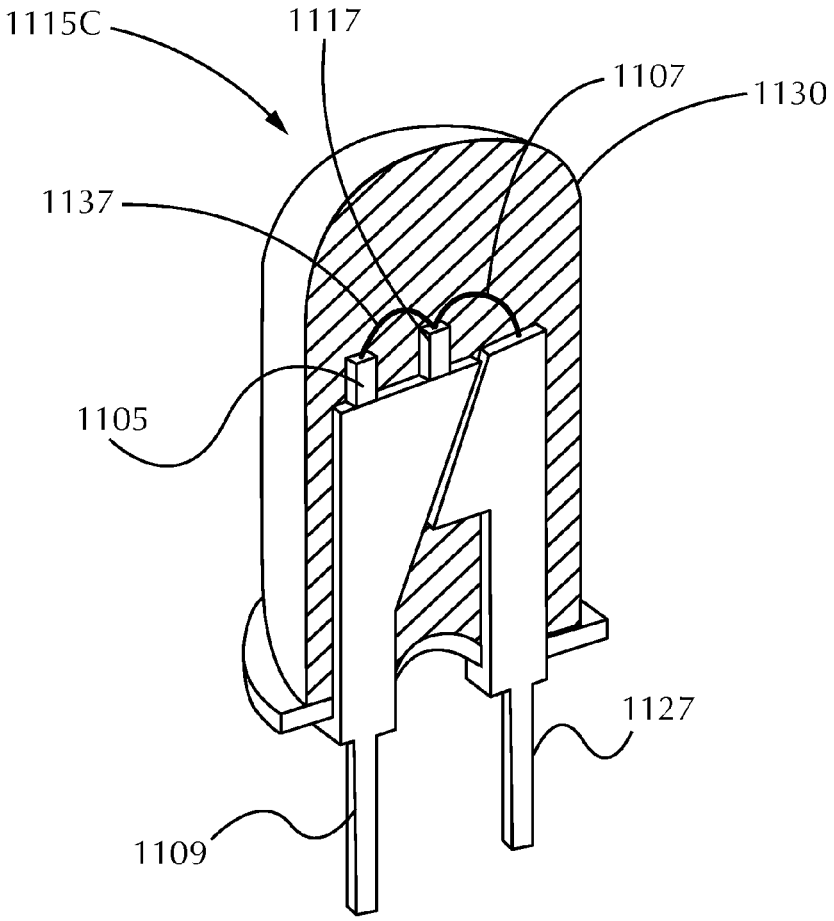

As shown in FIG. 11C, an LED 1115C may include multiple dices 1105 and 1117 connected in parallel. The LED 1115C may comprise a single light output, the lens 1130, and one positive lead 1109, and one negative lead 1127. The dices may have a parallel connection, wire bonding 1137 connecting the top of dices 1105 to the top of dices 1117, and wire bonding 1107 connecting the top of dices 1117 to the top of the common negative lead 1127. All light from the light emitting sources can be combined to result in a single light output at lens 1130 of LED 815C.

Figure 11D:
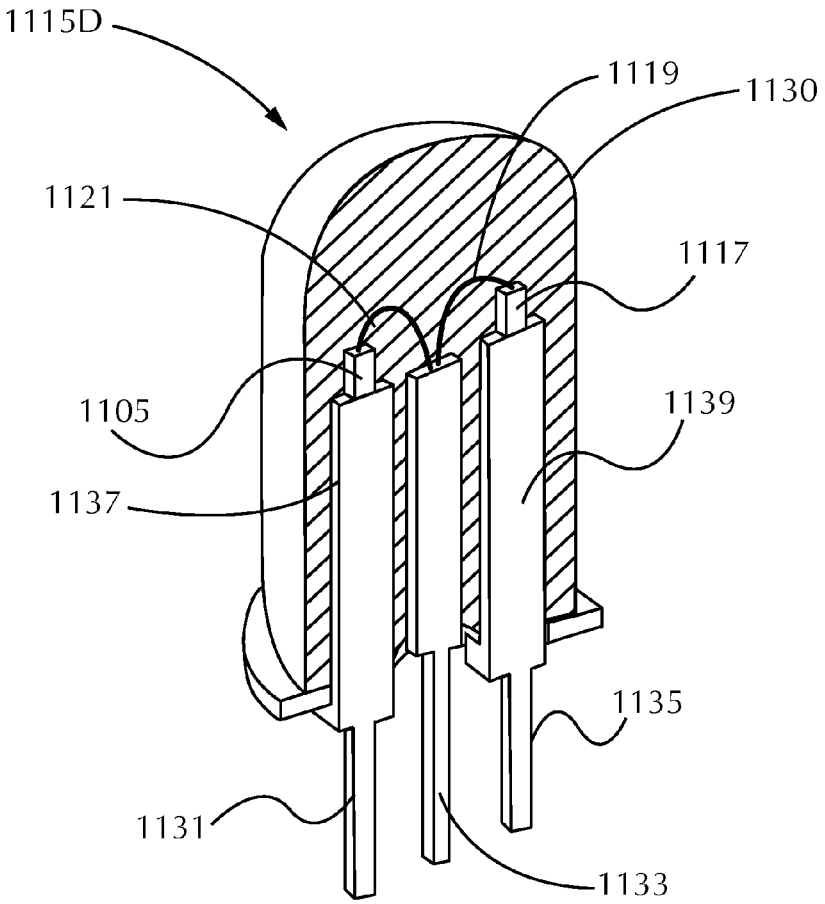

As shown in FIG. 11D, an LED 1115D (three wire LED) may include multiple dices 1105 and 1117. The LED 1115D may comprise a lens 1130, two semiconductor substrates, dices 1105 and 1117 shown connected in parallel, wire bondings 1119 and 1121, one positive lead 1133, and two negative leads 1131 and 1135. This LED 1115D also emits light from a single light output, the lens 1130. Each dice may have an individual pedestal 1137 and 1139. It is also contemplated that the LED 1115D can comprise two positive leads, and one negative lead; and the dices 1105 and 1117 can be connected in series.

Additionally, the LED can comprise more than two semiconductor substrates having light emitting properties, and the LED can comprise more than two leads. The LED can have a common or shared lead, or can have individual leads for each semi-conductor substrate having light emitting properties. Further, each semi-conductor substrate having light emitting properties can be individually powered by a separate power source, such as a battery.

One advantage of a three wire LED, e.g. LED 1115D, is that the dices 1105 and 1117 may be independently operated. For example, where the LED 1115D comprises two positive leads, the dices may be independently controlled. So, the first dice 1105 may be operated at eighty percent capacity while the second dice 1107 is operated at twenty percent capacity. As another example, the first dice 1105 may be operated at fifty percent while the second dice 1117 is operated at 100 percent. There are countless combinations for operating levels of the first dice 1105 and the second dice 1117. It is believed that such combinations can achieve color blends which create a unique visual effect for the user.

For two wire LEDs light blends are also possible. For example, the polarity of the supply voltage can be switched at a high enough rate, e.g. higher than 70 Hz, such that the dices can be driven and create a blended color effect. When the polarity of the supply voltage is in a first state, a first dice may be energized. When the polarity of the supply voltage is in a second state, a second dice may be energized. If the polarity of the supply voltage is switched fast enough, a user may perceive a color blend. The switching rate of the polarity of the supply voltage may be greater than about 70 Hz, greater than about 80 Hz, greater than about 90 Hz, greater than about 100 Hz, greater than about 110 Hz, greater than about 120 Hz, greater than about 130 Hz, less than about 130 Hz, less than about 120 Hz, less than about 110 Hz, less than about 100 Hz, less than about 90 Hz, or any number within the values provided or any ranges within the values provided.

As stated above, these dices can be electrically connected in parallel or in series. When they are connected in series, all current considerations are the same as for one single dice. The total voltage can be approximated by the equation below:

$$V=V_{f1}+V_{f2}+\ldots+V_{fn}$$

where n is equal to the number of dices and $V_f$=forward voltage for a particular dice. If the dices are connected in parallel, the total voltage is approximately that of a single dice.

Serial connection works well because it adjusts for differences between the dices. When the dices are connected in series, they automatically adjust their forward voltages and their luminous intensity become very close. In either arrangement the two dices have approximately the luminous intensity of $1.6\times P_i$, where $P_i$ is luminous intensity of a single dice. A three dices LED will likely have the luminous intensity of about $2.26\times P_i$. (Interference between the dices can prevent the luminous intensity calculation from being a multiplier by the number of dice.) These dices can deliver the same color of light, or they can have different colors of light. However, if each individual light emitter emits the same light, the luminous intensity of that color light from that one single LED is greater than a single standard LED emitting light of one color.

A single LED could also contain two dices emitting different colors of light, for example a wavelength selected from the range of greater than about 370, 380, 390, 400, 425, 440, 450, 475, 480 and/or less than about 500 nanometers. The dices could also be selected such that the dices emit light of a different wavelength within the same color range; for example the dices could emit light having different wavelengths that result in the color blue. Some colors are difficult to achieve by a single wavelength of light; this invention can be used to produce light of one of these unique colors. Thus the combination of different colors at the single optical output may result in a color that cannot be achieved by one dice alone.

For those embodiments comprising multiple LEDs or an LED with multiple dices, the oral hygiene implement of the present invention may provide the user with multiple signals. For example, a first dice may be energized providing the user with a first visual signal. The first visual signal may correlate to a predetermined amount of time brushed by the user, for example. A second dice may be energized providing the user with a second visual signal. The second visual signal may indicate to the user that it is time to replace the oral care device. In such embodiments, the first visual indication may comprise first color while the second visual indication comprises a second color which is different than the first color. Any suitable colors may be utilized.

For output signals which comprise a visible signal, placement of a light source, e.g. may be in any suitable location. While the light source may be placed on the handle, there is a tendency for the light source to be blocked from the view of the user by the user's hand. To facilitate viewing by the user, an area overlapping the neck and the handle can be particularly beneficial for the location of the light source. The area may be disposed on a backside surface of the toothbrush.

Additionally, the light source can be selected such that the light source has a wide dispersion angle. The light source can be positioned on the toothbrush such that the light emitted from the light source is in the line of sight of the user. In some embodiments, the light source can be positioned such that the light emitted from the light source shines on the face of the user. For example, the light from the light source can light up the user's face when activated. This shining of the light on the user's face can facilitate the viewing by the user even in the absence of a mirror. In such embodiments, the light source can be positioned asymmetrically with respect to a longitudinal axis of the toothbrush. In such embodiments, the light source may be positioned at an angle towards the face of the user.

The toothbrush of the present invention may further comprise a timer. The timer may be positioned inside the toothbrush or may be disposed in a remote display. The timer may be configured to begin automatically such as with the application of a brushing force. Independently, or in conjunction with the application of brushing force, the timer may be activated by motion of the toothbrush. In such embodiments, the toothbrush may comprise accelerometers or other suitable device for measuring/monitoring the motion of the toothbrush. Such devices for monitoring/measuring the motion of the toothbrush are described in U.S. Patent Application Ser. No. 61/116,327, entitled, "PERSONAL CARE SYSTEMS, PRODUCTS, AND METHODS", filed on Nov. 20, 2008. An example of a suitable timer is a 555 timer integrated circuit available from many electronics stores where integrated circuits are sold.

The toothbrush of the present invention may further comprise a power source as discussed previously. The power source may be any suitable element which can provide power to the toothbrush. A suitable example includes batteries. The battery may be sized in order to minimize the amount of real estate required inside the toothbrush. For example, where the electromagnetic source consists of a light emitting element or vibratory motor (used for signaling the user and not vibrating the cleaning elements of the head and/or movement of the head) the power source may be sized relatively small, e.g. smaller than a triple A battery. In such embodiments, the vibratory device may be relatively small. The battery may be rechargeable or may be disposable. Additionally, a plurality of batteries may be utilized. In some embodiments, the power source may include alternating current power as provided by a utility company to a residence. Other suitable power sources are described in U.S. patent application Ser. No. 12/102,881, filed on Apr. 15, 2008, and entitled, "Personal Care Products and Methods".

In some embodiments, a user operated switch may be provided which can allow the user to control when pressure indication begins as well as when the timer begins. The switch may be in electrical communication with the power source and the electromagnetic source and/or the timer.

In some embodiments, the toothbrush of the present invention may be comprised by an oral care system which further comprises an external display which is in signal communication with the toothbrush. In such embodiments, the external display and the toothbrush may communicate with one another via any suitable manner. Some suitable examples of communication between a personal hygiene device, e.g. toothbrush, and an external display are described in U.S. Patent Application Ser. Nos. 61/176,618, entitled, "PERSONAL CARE SYSTEMS, PRODUCTS, AND METHODS", filed on May 8, 2009; 61/180,617, entitled, "PERSONAL CARE SYSTEMS, PRODUCTS, AND METHODS", filed on May 22, 2009; and U.S. Patent Application Publication No. 2008/0109973. In such embodiments, the signal discussed herein may be provided to the user via the external display and/or via the indication element.

Any suitable material may be utilized for the first and second sealing elements. Some examples of suitable material include thermoplastic elastomers, silicone, nitrile butadiene rubber, ethylene propylene diene monomer rubber, or the like. Other suitable examples include thermoplastic elastomers, silicone based materials, NBR (nitrile butadiene rubber), EPDM (ethylene propylene diene monomer), Viton™, etc. Additionally, the sealing elements may be fixed to the handle in any suitable manner, for example, overmolding. In some embodiments, the handle and the sealing elements may overlap to some extent to help reduce the likelihood of contaminants entering between the seam of the sealing elements and the handle. In some embodiments, the material of the sealing elements may also extend along a portion or portions of the handle, to provide a gripping surface, e.g elastomer grip features.

Figure 12:
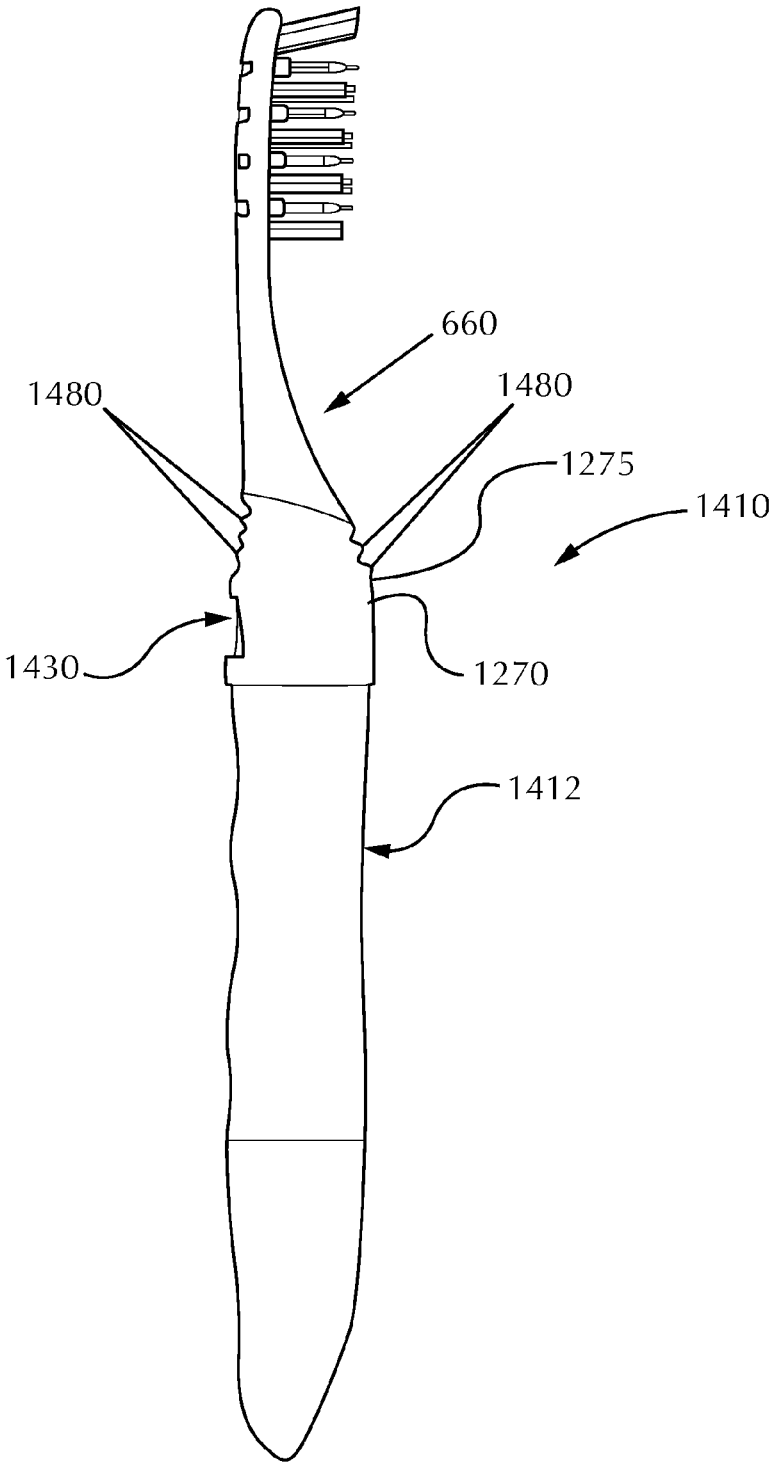
FIG. 12 is a side view showing a toothbrush constructed in accordance with the present invention.

In some embodiments, the sealing elements and/or elastomer grip feature(s) may include visual texture or features which provide a visual signal indicating the flexibility of the toothbrush. For example, as shown in FIG. 12, a toothbrush 1410 may comprise a handle 1412 having a first sealing element 1270 and a second sealing element 1275. The first sealing element 1270 and/or the second sealing element 1275 may comprise rugosities 1480. The rugosities 1480 may provide visual communication to the consumer regarding the flexibility of the toothbrush. As shown, an indication element 1430 may be positioned between the first sealing element 1270 and the second sealing element 1275 which may allow the indication element 1430 to provide a visual signal to the consumer.

As stated previously, the first sealing element and/or second sealing elements as described herein, may be transparent and/or translucent. In such embodiments, the sealing elements may enhance a visual signal be displaying light distributed by the reflective core.

The handle may be any suitable material. Some examples of suitable materials include polypropylene, ABS (acrylonitrile-butadiene-styrene copolymer), ASA (acrylonitrile-styrene-acrylate), copolyester, POM (polyaformaldeyde), combinations thereof, and the like. Additional suitable materials include polypropylene, nylon, high density polyethylene, other moldable stable polymers, the like, and/or combinations thereof. In some embodiments, the handle, the neck, and/or the head, may be formed from a first material and include recesses, channels, grooves, for receiving a second material which is different from the first. For example, the handle may include an elastomeric grip feature or a plurality of elastomeric grip features. The elastomers among the plurality of elastomeric grip features may be similar materials or may be different materials, e.g. color, hardness, combinations thereof or the like.

The elastomeric grip features of the handle may be utilized to overmold, at least in part, a portion of the timer, electromagnetic source, processor, indication element, and/or power source. In such embodiments, these components may be in electrical communication via wiring which can similarly be overmolded. The elastomeric grip features may include portions which are positioned for gripping by the palm of the user and/or portions which are positioned for gripping by the thumb and index finger of the user. These elastomeric grip features may be composed of the same material or may be different, e.g. color, shape, composition, hardness, the like, and/or combinations thereof.

The elastomeric grip features of the handle may be in communication with a channel, groove, and/or recess, in the neck via an external channel, groove, recess and/or via an internal channel, groove, recess. In some embodiments, the elastomeric grip features may be in communication with a channel, groove, and/or recess in the head via an internal channel, groove, and/or recess, and/or an external channel, groove, and/or recess. Alternatively, the grip features of the handle may be discrete elements from the features of the head and/or neck.

In some embodiments, recycled and/or plant derived plastics may be utilized. For example, PET may be utilized in some embodiments. The PET may be bio based. For example, the PET may comprise from about 25 to about 75 weight percent of a terephthalate component and from about 20 to about 50 weight percent of a diol component, wherein at least about one weight percent of at least one of the terephthalate and/or the diol component is derived from at least one bio-based material. Similarly, the terephthalate component may be derived from a bio based material. Some examples of suitable bio based materials include but are not limited to corn, sugarcane, beet, potato, starch, citrus fruit, woody plant, cellulosic lignin, plant oil, natural fiber, oily wood feedstock, and a combination thereof.

Some of the specific components of the PET may be bio based. For example, monoethylene glycol and terephthalic acid may be formed from bio based materials. The formation of bio based PET and its manufacture are described in United States Patent Application Publication Nos. 20090246430A1 and 20100028512A1.

Additionally, as used herein, the term "contact elements" is used to refer to any suitable element which can be inserted into the oral cavity. Some suitable elements include bristle tufts, elastomeric massage elements, elastomeric cleaning elements, massage elements, tongue cleaners, soft tissue cleaners, hard surface cleaners, combinations thereof, and the like. The head may comprise a variety of contact elements. For example, the head may comprise bristles, abrasive elastomeric elements, elastomeric elements in a particular orientation or arrangement, e.g. pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

The contact elements may be attached to the head in any suitable manner. Conventional methods include stapling, anchor free tufting, and injection mold tufting. For those contact elements that comprise an elastomer, these elements may be formed integral with one another, e.g. having an integral base portion and extending outward therefrom.

The head may comprise a soft tissue cleanser constructed of any suitable material. Some examples of suitable material include elastomeric materials; polypropylene, polyethylene, etc; the like, and/or combinations thereof. The soft tissue cleanser may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

For those embodiments which include an elastomeric element on a first side of the head and an elastomeric element on a second side of the head (opposite the first), the elastomeric elements may be integrally formed via channels or gaps which extend through the material of the head. These channels or gaps can allow elastomeric material to flow through the head during an injection molding process such that both the elastomeric elements of the first side and the second side may be formed in one injection molding step.

In such embodiments including a soft tissue cleanser, consumer testing, robot testing, and/or clinical testing may be performed such that an upper threshold of force and a lower threshold of force can be established to provide feedback to the user with regard to the applied force to soft tissue, e.g. tongue. For those embodiments, including a soft tissue cleanser, the toothbrush may comprise an accelerometer or other suitable device for monitoring the orientation of the toothbrush. In combination with the applied force, e.g. brushing force, the processor can determine whether the soft tissue cleanser is being engaged or the cleaning elements are being engaged. The signal or a plurality of signals may be provided to the user as described herein. Providing feedback to the user regarding the applied force to soft tissue can assist the user in preventing damage to the soft tissue, e.g. papillae, while still achieving efficacious cleaning.

Test Method for Determining Applied Force for which Indication Occurs

Figure 16:
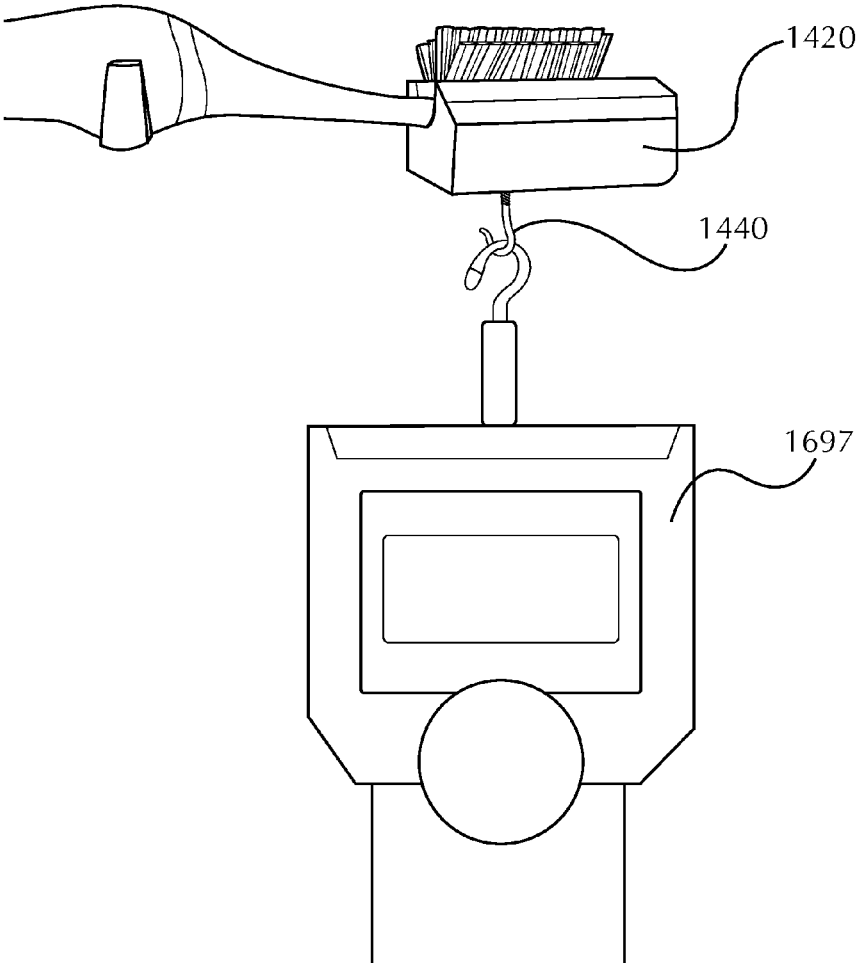
FIG. 16 is a close up view showing a force gauge attached to the pull block of FIGS. 14 and 15.

The test for determining an applied force for which indication occurs requires an adjustable frame and a force gauge 1697 (Shown in FIG. 16). The force gauge used should be capable of providing force readouts to at least two places to the right of a decimal (hundredths of a Newton). A suitable force gauge is available from Lutron Electronic Enterprise Co., Ltd. and available under model number FG-20KG. Prior to testing, the force gauge should be calibrated according to the manufacturer's recommendations or should be sent to the manufacturer for calibration.

Figure 13:
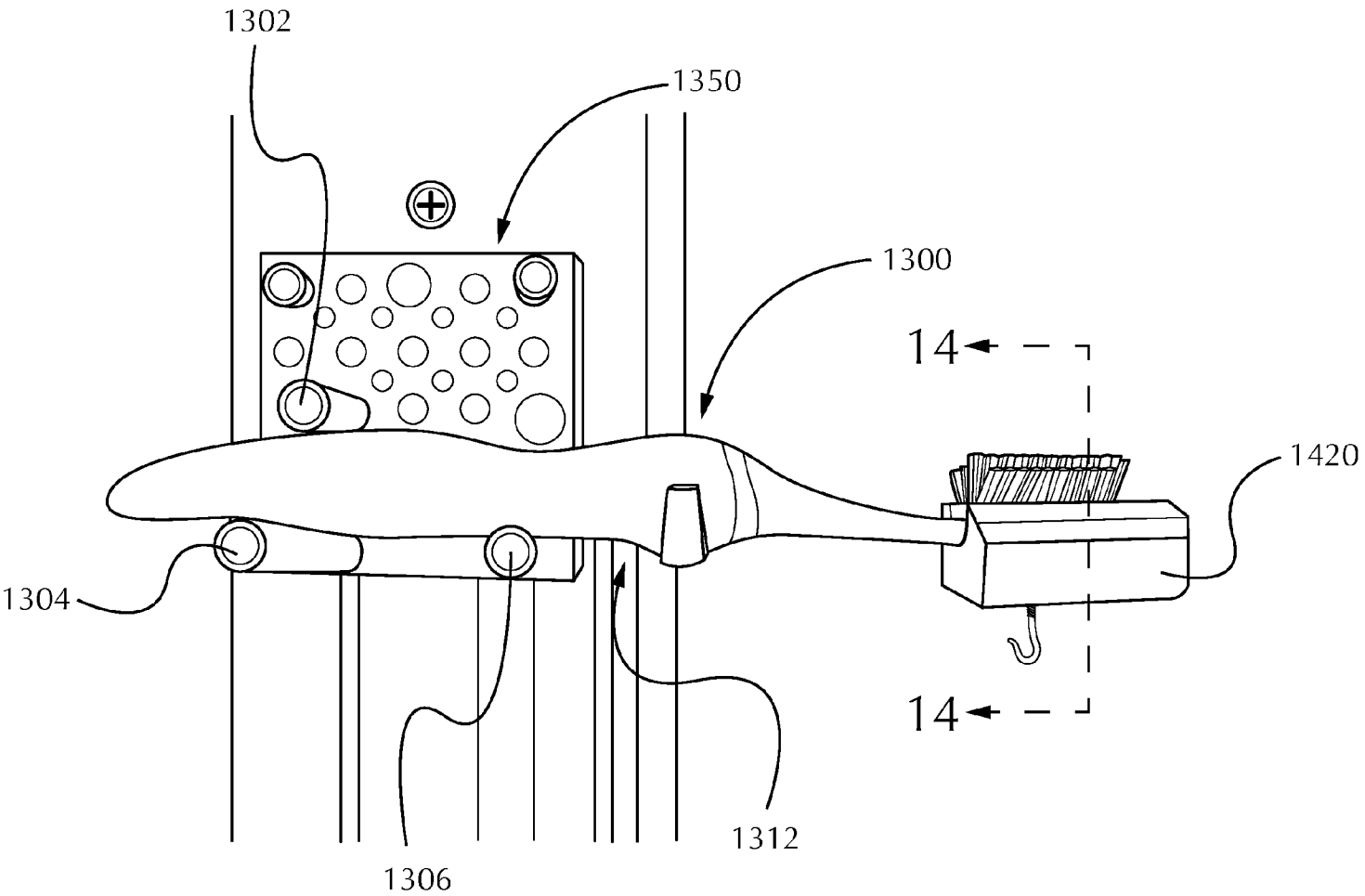
FIG. 13 shows a sample toothbrush fixed in a frame for testing.

As shown in FIG. 13, place a sample toothbrush 1300 into a three point fixture 1350 on the adjustable frame. The three point fixture 1350 will hold a handle region 1312 of the toothbrush 1300 via a first point 1302, a second point 1304, and a third point 1306. The points 1302, 1304, 1306, should be adjusted to preclude movement of the handle region 1312 during testing. Additionally, the toothbrush 1300 should be fixed in the fixture 1350, such that the head 1314 (shown in FIG. 14) is substantially parallel to a horizontal surface.

Figure 14:
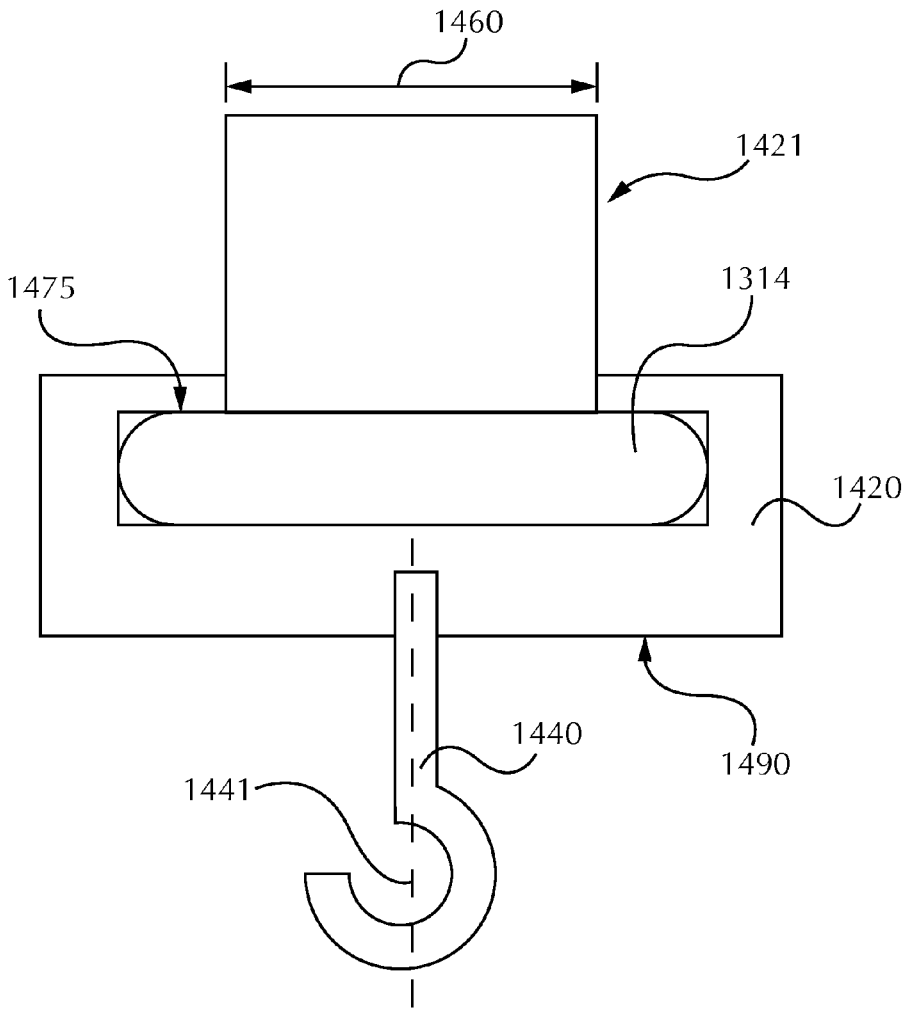
FIG. 14 is a cross sectional view showing the sample toothbrush of FIG. 13 and a pull block on a toothbrush head of the sample toothbrush.

A pull block 1420 is attached to a head 1314 (Shown in FIG. 14 and covered by the pull block 1420 in FIG. 13) of the toothbrush 1300. The pull block 1420 should be made of a rigid material which can allow a force of 10 Newtons to 15 Newtons to be applied to the head 1314 of the toothbrush 1300. As shown in FIG. 14, the pull block 1420 should engage a top surface 1475 of the head. No cleaning elements 1421 should be positioned between the top surface 1475 and the pull block 1420. If required, cleaning elements 1421 or a portion thereof, may be removed in order to allow the pull block 1420 to properly engage the top surface 1475 of the head 1314.

The pull block 1420 should be constructed such that a hook 1440 can extend from an underside 1490 of the pull block 1420. The hook 1440 can be attached in any suitable manner to the pull block 1420. The hook 1440 should be rigidly fixed to the pull block 1420, such that the hook 1440 does not move relative to the pull block 1420 during testing. The hook 1440 should be positioned on the pull block 1420 such that a centerline 1441 of the hook 1440 bisects a distance 1460 of the cleaning elements 1421. The distance 1460 is the maximum straight line distance between cleaning elements which are furthest apart from one another along a lateral direction.

Figure 15:
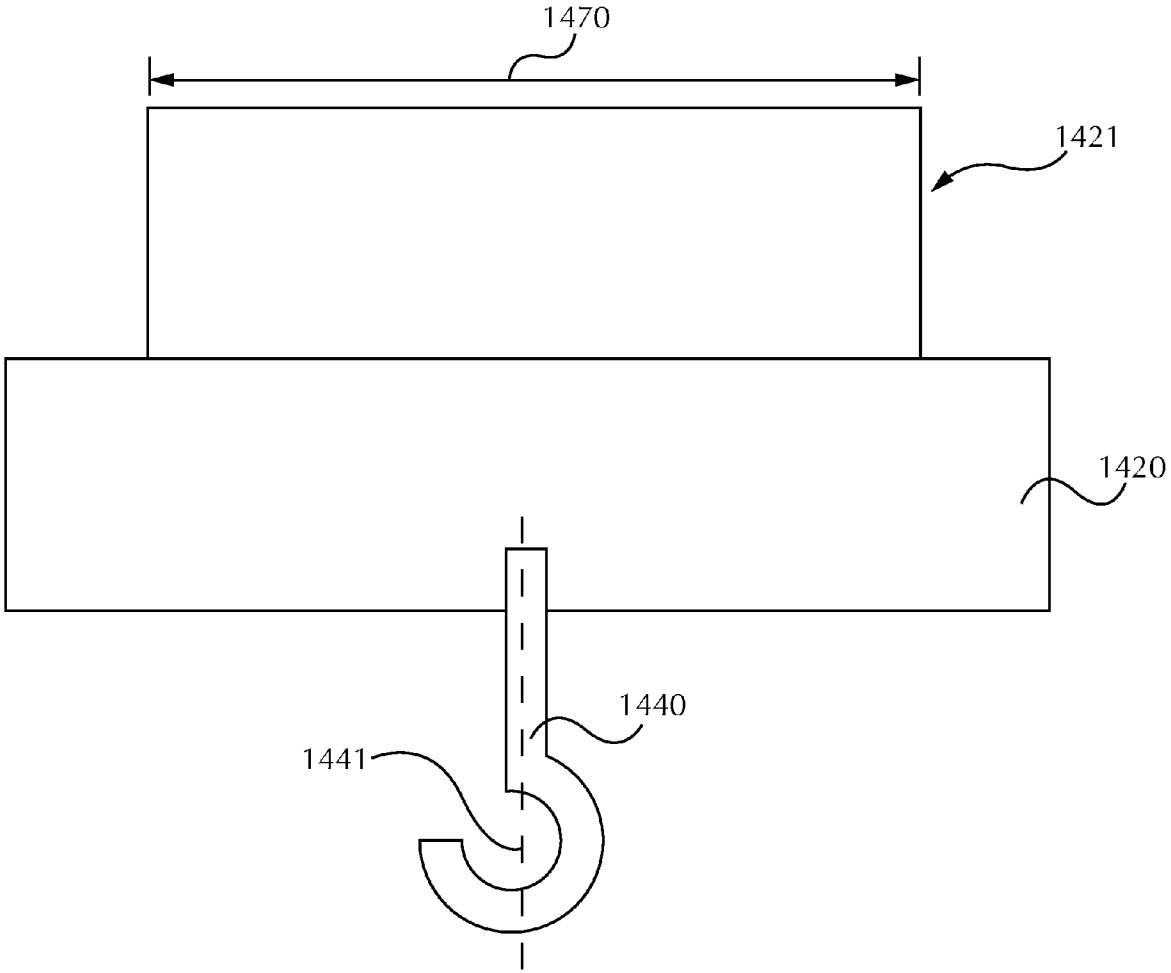
FIG. 15 is a close up view showing the sample toothbrush of FIG. 13 and the pull block on the toothbrush head of the sample toothbrush.

As shown in FIG. 15, the hook 1440 should be positioned on the pull block 1420 such that the centerline 1441 bisects a distance 1470 of the cleaning elements 1421. The distance 1470 is the maximum straight line distance between cleaning elements which are furthest apart from one another along a longitudinal direction.

Hang the force gauge 1697 from the hook 1440 of the pull block 1420. A lower end (not shown) of the force gauge 1697 should be fixed to the horizontal surface to which the head 1314 (shown in FIG. 13) of the toothbrush is substantially parallel. The force gauge 1697 is fixed to the horizontal surface such that the force gauge is plumb with the horizontal surface. Raise the adjustable frame until indication of a predetermined force is provided by the toothbrush 1300. Record the reading on the force gauge 1697. Repeat the test five times on additional samples of the toothbrush 1300.

Test Method for Determining Light Emission Efficiency

Obtain three samples of the brush to be tested and three samples of the output source utilized in the brush. The samples of the output source should be identical to that utilized in the brush. Take all samples, i.e. three brush samples and three samples of the output source, to an independent testing facility. The testing facility will test each of the three samples of the brush and each of the samples of the output source in an appropriately sized integrating sphere. For example, a 12 inch integrating sphere may be suitable to fit the brush samples.

The testing facility will calibrate all equipment prior to measurement of any samples. The samples of the output source will be tested prior to the testing of the brushes. The testing facility will place one sample of the output source in the integrating sphere in accordance with standard testing procedures. The output source will be powered by the same voltage as that provided in the brush. Specifically, if the brush utilizes two 1.5 volt watch batteries, then the output source shall similarly be powered by two 1.5 volt watch batteries.

The output source shall be powered on, the integrating sphere closed, and the total light radiated from the output source shall be measured. Each of the remaining samples of output source shall be measured similarly. The total light output of each of the samples of output source will be recorded and noted by each sample.

Remove the sample output source from the integrating sphere prior to testing a sample brush. Place a sample brush in the integrating sphere configured in such a manner as to activate the output source of the brush without blocking the light emitted from the indication element of the brush. For example, where the indication element provides a visual indication of too much pressure being applied, a harness may be utilized to move the head/neck of the brush to ensure that the indication element/output source is activated. Measure the total light radiated from the sample brush. Repeat for the remaining samples of brush.

The total light radiated from sample output source one will be divided by the total light radiated from sample brush one. The quotient is then multiplied by 100 to determine percent one. The total light radiated from sample output source two will be divided by the total light radiated from sample brush two. The quotient is then multiplied by 100 to determine percentage two. The total light radiated from sample output source three will be divided by the total light radiated from sample brush three. The quotient is then multiplied by 100 to determined percentage three. The percentages one, two, and three, are averaged to obtain the percent efficiency.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral hygiene handle having a housing, a cavity therein, and an insert disposed within the cavity, the insert comprising:

a load member capable of pivoting with respect to the housing;

an output source disposed in electromagnetic communication with the load member, the output source having a first contact arm and a second contact arm;

a power source in electrical communication with the output source, the power source having a first contact area and a second contact area;

an engagement section capable of receiving an oral care attachment; and an indication element forming an outer facing surface of the handle, wherein when the load member pivots a predetermined amount, the first contact arm makes contact with a first contact area and/or the second contact arm makes contact with the second contact area thereby causing the power source to deliver power to the output source, wherein the output source provides electromagnetic energy to the load member, wherein the load member transmits the electromagnetic energy from the output source to the indication element, and wherein load member, the indication element, and the engagement section are integral with one another.

2. The oral hygiene handle of claim 1 further comprising a reflective core disposed between the load member and the indication element, the reflective core distributing electromagnetic energy from the load member to the indication element.

3. The oral hygiene handle of claim 2, wherein the reflective core comprises a polished area disposed within the indication element.

4. The oral hygiene handle of claim 1, wherein the load member transmits the electromagnetic energy of the output source via internal reflection.

5. The oral hygiene handle of claim 1, wherein the load member comprises a receptacle for the output source.

6. The oral hygiene handle of claim 1, wherein the load member comprises a material having a refractive index of greater than about 1.0.

7. The oral hygiene handle of claim 6, wherein the refractive index is greater than about 1.5.

8. The oral hygiene handle of claim 1, further comprising a support, the support being fixedly attached to the handle such that during operation the support does not move with respect to the handle.

9. The oral hygiene handle of claim 8, wherein the load member is pivotally attached to the support.

10. The oral hygiene handle of claim 8, wherein the load member is integral with the support.

11. The oral hygiene handle of claim 1, further comprising a first sealing element and a second sealing element, the first sealing element being between the handle and the insert, and the second sealing element being positioned between the indication element and the engagement section.

12. The oral hygiene handle of claim 11 wherein the first sealing element and/or the second sealing element are translucent or transparent.

* * * * *